US007234544B2

(12) United States Patent
Kent

(10) Patent No.: US 7,234,544 B2
(45) Date of Patent: Jun. 26, 2007

(54) DRILL TOOL SHAFT-TO-HOUSING LOCKING DEVICE

(75) Inventor: Gerald Edward Kent, Spruce Grove (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/876,661

(22) Filed: Jun. 28, 2004

(65) Prior Publication Data

US 2004/0231893 A1 Nov. 25, 2004

Related U.S. Application Data

(62) Division of application No. 10/180,117, filed on Jun. 27, 2002, now Pat. No. 6,769,499.

(30) Foreign Application Priority Data

Jun. 28, 2001 (CA) ..... 2351978

(51) Int. Cl.
*E21B 23/02* (2006.01)

(52) U.S. Cl. ..... 175/74; 175/306; 175/325.6

(58) Field of Classification Search ..... 175/73, 175/74, 256, 300, 306, 321, 325.6, 325.7
See application file for complete search history.

(56) References Cited

U.S. PATENT DOCUMENTS

| | | | |
|---|---|---|---|
| 2,072,320 | A | 3/1937 | Thomas |
| 2,323,027 | A | 6/1943 | Gerstenkorn |
| 2,696,367 | A | 12/1954 | Robishaw |

(Continued)

FOREIGN PATENT DOCUMENTS

| | | | |
|---|---|---|---|
| CA | 2298375 | | 9/2000 |
| CA | 2314575 | | 1/2001 |
| EP | 0718641 | A | 6/1996 |
| GB | 2017191 | | 10/1979 |
| GB | 2172324 | | 9/1986 |
| GB | 2172325 | | 9/1986 |
| GB | 2177738 | | 1/1987 |
| GB | 2257447 | A | 1/1993 |
| GB | 2307537 | | 5/1997 |
| WO | WO-90/07625 | | 7/1990 |
| WO | WO-90/08245 | | 7/1990 |
| WO | WO-99/24688 | | 5/1999 |
| WO | WO-00/61916 | | 10/2000 |

OTHER PUBLICATIONS

Warren T: "Technology Gains Momentum," Oil and Gas Journal, US, Pennwell Publishing Co., Tulsa, vol. 96, No. 51, Dec. 21, 1998, pp. 101–105.

Schaaf, Stuart et. al., "Field Application of a Fully Rotating Point–the–bit Rotary Steerable System," SPE/IADC Drilling Conference Paper No. 67716, Feb. 27, 2001.

European Search Report for related European application. Oct. 6,2005.*

*Primary Examiner*—Zakiya W. Bates
(74) *Attorney, Agent, or Firm*—Terrence N. Kuharchuk; William Shull; Micheal D. McCully

(57) ABSTRACT

In a tool having an inner member supported within an outer member, wherein the tool defines a longitudinal axis, a device is provided for preventing relative rotation of the inner member and the outer member. The device is comprised of a locking mechanism and a locking actuator. The locking mechanism is positioned between the inner member and the outer member, wherein the locking mechanism is movable longitudinally between a first locking mechanism position in which the inner member and the outer member are disengaged and capable of relative rotation and a second locking mechanism position in which the inner member and the outer member are engaged and not capable of relative rotation. The locking actuator causes the locking mechanism to move longitudinally.

41 Claims, 24 Drawing Sheets

U.S. PATENT DOCUMENTS

| | | | | | |
|---|---|---|---|---|---|
| 2,815,930 | A | | 12/1957 | Storm | |
| 3,823,787 | A | | 7/1974 | Haworth et al. | |
| 4,476,943 | A | | 10/1984 | Williams | |
| 4,705,117 | A | | 11/1987 | Warren et al. | |
| 4,989,679 | A | | 2/1991 | Amaudric du Chaffaut | |
| 5,034,929 | A | | 7/1991 | Cobern et al. | |
| 5,048,621 | A | | 9/1991 | Bailey et al. | |
| 5,117,927 | A | | 6/1992 | Askew | 175/61 |
| 5,139,094 | A | | 8/1992 | Prevedel et al. | |
| 5,307,885 | A | | 5/1994 | Kuwana et al. | |
| 5,314,030 | A | | 5/1994 | Peterson | |
| 5,314,032 | A | | 5/1994 | Pringle et al. | |
| 5,339,913 | A | | 8/1994 | Rives | 175/73 |
| 5,353,884 | A | | 10/1994 | Misawa et al. | |
| 5,368,110 | A | | 11/1994 | French | 175/57 |
| 5,421,421 | A | | 6/1995 | Appleton | |
| 5,535,835 | A | * | 7/1996 | Walker | 175/73 |
| 5,685,379 | A | | 11/1997 | Barr et al. | |
| 5,706,905 | A | | 1/1998 | Barr | |
| 5,803,185 | A | | 9/1998 | Barr et al. | |
| 5,875,859 | A | | 3/1999 | Ikeda et al. | |
| 5,931,239 | A | | 8/1999 | Schuh | |
| 6,158,529 | A | | 12/2000 | Dorel | |
| 6,234,259 | B1 | | 5/2001 | Kuckes et al. | |
| 6,244,345 | B1 | * | 6/2001 | Helms | 166/301 |
| 6,244,361 | B1 | | 6/2001 | Comeau et al. | |
| 6,290,003 | B1 | | 9/2001 | Russell | |
| 6,401,842 | B2 | | 6/2002 | Webb et al. | |
| 2002/0175003 | A1 | | 11/2002 | Pisoni et al. | |

* cited by examiner

DRILL TOOL SHAFT-TO-HOUSING LOCKING DEVICE

FIELD OF INVENTION

The present invention relates to improvements in a drilling direction control device, and in particular, to a shaft-to-housing locking device therefor.

BACKGROUND OF INVENTION

Directional drilling involves varying or controlling the direction of a wellbore as it is being drilled. Usually the goal of directional drilling is to reach or maintain a position within a target subterranean destination or formation with the drilling string. For instance, the drilling direction may be controlled to direct the wellbore towards a desired target destination, to control the wellbore horizontally to maintain it within a desired payzone or to correct for unwanted or undesired deviations from a desired or predetermined path.

Thus, directional drilling may be defined as deflection of a wellbore along a predetermined or desired path in order to reach or intersect with, or to maintain a position within, a specific subterranean formation or target. The predetermined path typically includes a depth where initial deflection occurs and a schedule of desired deviation angles and directions over the remainder of the wellbore. Thus, deflection is a change in the direction of the wellbore from the current wellbore path. This deflection may pertain to deviation of the wellbore path relative to vertical or to change in the horizontal direction or azimuth of the wellbore path.

It is often necessary to adjust the direction of the wellbore frequently while directional drilling, either to accommodate a planned change in direction or to compensate for unintended or unwanted deflection of the wellbore. Unwanted deflection may result from a variety of factors, including the characteristics of the formation being drilled, the makeup of the bottomhole drilling assembly and the manner in which the wellbore is being drilled.

Deflection is measured as an amount of deviation of the wellbore from the current wellbore path and is expressed as a deviation angle or hole angle. Deflection may also relate to a change in the azimuth of the wellbore path. Commonly, the initial wellbore path is in a vertical direction. Thus, initial deflection often signifies a point at which the wellbore has deflected off vertical in a particular azimuthal direction. Deviation is commonly expressed as an angle in degrees from the vertical. Azimuth is commonly expressed as an angle in degrees relative to north.

Various techniques may be used for directional drilling. First, the drilling bit may be rotated by a downhole motor which is powered by the circulation of fluid supplied from the surface. This technique, sometimes called "sliding drilling", is typically used in directional drilling to effect a change in direction of the a wellbore, such as the building of an angle of deflection. However, various problems are often encountered with sliding drilling.

For instance, sliding drilling typically involves the use of specialized equipment in addition to the downhole drilling motor, including bent subs or motor housings, steering tools and nonmagnetic drill string components. As well, the downhole motor tends to be subject to wear given the traditional, elastomer motor power section. Furthermore, since the drilling string is not rotated during sliding drilling, it is prone to sticking in the wellbore, particularly as the angle of deflection of the wellbore from the vertical increases, resulting in reduced rates of penetration of the drilling bit. Other traditional problems related to sliding drilling include stick-slip, whirling, differential sticking and drag problems. For these reasons, and due to the relatively high cost of sliding drilling, this technique is not typically used in directional drilling except where a change in direction is to be effected.

Second, directional drilling may be accomplished by rotating the entire drilling string from the surface, which in turn rotates a drilling bit connected to the end of the drilling string. More specifically, in rotary drilling, the bottomhole assembly, including the drilling bit, is connected to the drilling string which is rotatably driven from the surface. This technique is relatively inexpensive because the use of specialized equipment such as downhole drilling motors can usually be kept to a minimum. In addition, traditional problems related to sliding drilling, as discussed above, are often reduced. The rate of penetration of the drilling bit tends to be greater, while the wear of the drilling-bit and casing are often reduced.

However, rotary drilling tends to provide relatively limited control over the direction or orientation of the resulting wellbore as compared to sliding drilling, particularly in extended-reach wells. Thus rotary drilling has tended to be largely used for non-directional drilling or directional drilling where no change in direction is required or intended.

Third, a combination of rotary and sliding drilling may be performed. Rotary drilling will typically be performed until such time that a variation or change in the direction of the wellbore is desired. The rotation of the drilling string is typically stopped and sliding drilling, through use of the downhole motor, is commenced. Although the use of a combination of sliding and rotary drilling may permit satisfactory control over the direction of the wellbore, the problems and disadvantages associated with sliding drilling are still encountered.

Some attempts have been made in the prior art to address these problems. Specifically, attempts have been made to provide a steerable rotary drilling apparatus or system for use in directional drilling. However, none of these attempts have provided a fully satisfactory solution.

United Kingdom Patent No. GB 2,172,324 issued Jul. 20, 1988 to Cambridge Radiation Technology Limited ("Cambridge") utilizes a control module comprising a casing having a bearing at each end thereof for supporting the drive shaft as it passes through the casing. Further, the control module is comprised of four flexible enclosures in the form of bags located in the annular space between the drilling string and the casing to serve as an actuator. The bags actuate or control the direction of drilling by applying a radial force to the drive shaft within the casing such that the drive shaft is displaced laterally between the bearings to provide a desired curvature of the drive shaft. Specifically, hydraulic fluid is selectively conducted to the bags by a pump to apply the desired radial force to the drilling string.

Thus, the direction of the radial force applied by the bags to deflect the drive shaft is controlled by controlling the application of the hydraulic pressure from the pump to the bags. Specifically, one or two adjacent bags are individually fully pressurized and the two remaining bags are depressurized. As a result, the drive shaft is deflected and produces a curvature between the bearings at the opposing ends of the casing of the control module. This controlled curvature controls the drilling direction.

United Kingdom Patent No. GB 2,172,325 issued Jul. 20, 1988 to Cambridge and United Kingdom Patent No. GB 2,177,738 issued Aug. 3, 1988 to Cambridge describe the use of flexible enclosures in the form of bags in a similar manner to accomplish the same purpose. Specifically, the drilling string is supported between a near bit stabilizer and a far bit stabilizer. A control stabilizer is located between the near and far bit stabilizers for applying a radial force to the drilling string within the control stabilizer such that a bend or curvature of the drilling string is produced between the near bit stabilizer and the far bit stabilizer. The control stabilizer is comprised of four bags located in the annular space between a housing of the control stabilizer and the drilling string for applying the radial force to the drilling string within the control stabilizer.

United Kingdom Patent Application No. GB 2,307,537 published May 28, 1997 by Astec Developments Limited describes a shaft alignment system for controlling the direction of rotary drilling. Specifically, a shaft, such as a drilling string, passes through a first shaft support means having a first longitudinal axis and a second shaft support means having a second longitudinal axis. The first and second shaft support means are rotatably coupled by bearing means having a bearing rotation axis aligned at a first non-zero angle with respect to the first longitudinal axis and aligned at a second non-zero angle with respect to the second longitudinal axis. As a result, relative rotation of the first and second shaft support means about their respective longitudinal axes varies the relative angular alignment of the first and second longitudinal axes.

The shaft passing through the shaft alignment system is thus caused to bend or curve in accordance with the relative angular alignment of the first and second longitudinal axes of the first and second shaft support means. The shaft may be formed as a unitary item with a flexible central section able to accommodate the desired curvature or it may be comprised of a coupling, such as a universal joint, to accommodate the desired curvature.

U.S. Pat. No. 5,685,379 issued Nov. 11, 1997 to Barr et. al., U.S. Pat. No. 5,706,905 issued Jan. 13, 1998 to Barr et. al. and U.S. Pat. No. 5,803,185 issued Sep. 8, 1998 to Barr et. al. describe a steerable rotary drilling system including a modulated bias unit, associated with the drilling bit, for applying a lateral bias to the drilling bit in a desired direction to control the direction of drilling. The bias unit is comprised of three equally spaced hydraulic actuators, each having a movable thrust member which is displaceable outwardly for engagement with the wellbore. The hydraulic actuators are operated in succession as the bias unit rotates during rotary drilling, each in the same rotational position, so as to displace the bias unit laterally in a selected direction.

PCT International Application No. PCT/US98/24012 published May 20, 1999 as No. WO 99/24688 by Telejet Technologies, Inc. describes the use of a stabilizer assembly for directional drilling. More particularly, a stabilizer sub is connected with the rotary drilling string such that the stabilizer sub remains substantially stationary relative to the wellbore as the drilling string rotates. The stabilizer sub includes a fixed upper stabilizer and an adjustable lower stabilizer. The lower adjustable stabilizer carries at least four stabilizer blades which are independently radially extendable from the body of the stabilizer sub for engagement with the wellbore.

Each stabilizer blade is actuated by a motor associated with each blade, which extends and retracts the blade through longitudinal movement of the stabilizer body relative to the stabilizer blade. Because each stabilizer blade is provided with its own motor, the stabilizer blades are independently extendable and retractable with respect to the body of the stabilizer sub. Accordingly, each blade may be selectively extended or retracted to provide for the desired drilling direction.

U.S. Pat. No. 5,307,885 issued May 3, 1994 to Kuwana et. al., U.S. Pat. No. 5,353,884 issued Oct. 11, 1994 to Misawa et. al. and U.S. Pat. No. 5,875,859 issued Mar. 2, 1999 to Ikeda et. al. all utilize harmonic drive mechanisms to drive rotational members supporting the drilling string eccentrically to deflect the drilling string and control the drilling direction.

More particularly, Kuwana et. al. describes a first rotational annular member connected with a first harmonic drive mechanism a spaced distance from a second rotational annular member connected with a second harmonic drive mechanism. Each rotational annular member has an eccentric hollow portion which rotates eccentrically around the rotational axis of the annular member. The drilling string is supported by the inner surfaces of the eccentric portions of the annular members. Upon rotation by the harmonic drive mechanisms, the eccentric hollow portions are rotated relative to each other in order to deflect the drilling string and change the orientation of the drilling string to the desired direction. Specifically, the orientation of the drilling string is defined by a straight line passing through the centres of the respective hollow portions of the annular members.

Misawa et. al. describes harmonic drive mechanisms for driving first and second rotatable annular members of a double eccentric mechanism. The first rotatable annular member defines a first eccentric inner circumferential surface. The second rotatable annular member, rotatably supported by the first eccentric inner circumferential surface of the first annular member, defines a second eccentric inner circumferential surface. The drilling string is supported by the second eccentric inner circumferential surface of the second annular member and uphole by a shaft retaining mechanism. Thus, upon actuation of the harmonic drive mechanisms, the first and second annular members are rotated resulting in the movement of the center of the second eccentric circumferential surface. Thus the drilling string is deflected from its rotational centre in order to orient it in the desired direction.

Upon deflection of the drilling string, the fulcrum point of the deflection of the drilling string tends to be located at the upper supporting mechanism, i.e. the upper shaft retaining mechanism. As a result, it has been found that the drilling string may be exposed to excessive bending stress.

Similarly, Ikeda et. al. describes harmonic drive mechanisms for driving first and second rotatable annular members of a double eccentric mechanism. However, Ikeda et. al. requires the use of a flexible joint, such as a universal joint, to be connected into the drilling string at the location at which the maximum bending stress on the drilling string takes place in order to prevent excessive bending stress on the drilling string. Thus, the flexible joint is located adjacent the upper supporting mechanism. Upon deflection of the drilling string by the double eccentric mechanism, the deflection is absorbed by the flexible joint and thus a bending force is not generated on the drilling string. Rather, the drilling string is caused to tilt downhole of the double eccentric mechanism. A fulcrum bearing downhole of the double eccentric mechanism functions as a thrust bearing and serves as a rotating centre for the lower portion of the drilling string to accommodate the tilting action.

However, it has been found that the use of a flexible or articulated shaft to avoid the generation of excessive bending force on the drilling string may not be preferred. Specifically, it has been found that the articulations of the flexible or articulated shaft may be prone to failure.

Canadian Patent Application No. 2,298,375 by Schlumberger Canada Limited, laid-open on Sep. 15, 2000, describes a rotary steerable drilling system which includes a pivoting offsetting mandrel which is supported within a tool collar by a knuckle joint and which in turn supports a drilling bit. The angular position of the offsetting mandrel is controlled by an arrangement of hydraulic pistons which are disposed between the offsetting mandrel and the tool collar and which can be selectively extended and retracted to move the offsetting mandrel relative to the tool collar. This system is therefore somewhat complicated, requiring the use of the articulating knuckle joint and a plurality of independently actuatable hydraulic pistons.

U.S. Pat. No. 6,244,361 B1 issued Jun. 12, 2001 to Halliburton Energy Services, Inc., describes a drilling direction control device which includes a rotatable drilling shaft, a housing for rotatably supporting the drilling shaft, and a deflection assembly. The deflection assembly includes an eccentric outer ring and an eccentric inner ring which can be selectively rotated to bend the drilling shaft in various directions. The deflection assembly is actuated by a harmonic drive system, which is a relatively complex and expensive apparatus to construct and maintain.

As a result, there remains a need in the industry for a relatively simple and economical steerable rotary drilling device or drilling direction control device for use with a rotary drilling string which can provide relatively accurate control over the trajectory or orientation of the drilling bit during the drilling operation, while also avoiding the generation of excessive bending stress on the drilling string.

There is also a need for such a drilling direction control device which is adaptable for use in a relatively small diameter embodiment.

SUMMARY OF INVENTION

The present invention is directed at improvements in a drilling direction control device of the general type described in U.S. Pat. No. 6,244,361 B1 (Halliburton Energy Services, Inc.), comprising:

(a) a rotatable drilling shaft;

(b) a housing for rotatably supporting a length of the drilling shaft for rotation therein; and (c) a drilling shaft deflection assembly contained within the housing and axially located between a first support location and a second support location, for bending the drilling shaft between the first support location and the second support location.

The contents of U.S. Pat. No. 6,244,361 B1 are hereby incorporated by reference into this Specification.

In particular, the invention is comprised of a drilling shaft deflection assembly for use in a drilling direction control device of the type described above. The invention may also be comprised of an indexing assembly, a housing locking assembly and a housing orientation sensor apparatus.

The function of the drilling shaft deflection assembly is to create a bend in the drilling shaft. The function of the indexing assembly is to orient the bend in the drilling shaft to provide a desired toolface orientation. The function of the housing locking assembly is to selectively engage the housing with the drilling shaft so that the housing and the drilling shaft rotate together. The function of the housing orientation sensor apparatus is to provide a relatively simple apparatus for sensing the orientation of the housing relative to some reference orientation.

In one apparatus aspect of the invention, the invention is comprised of a drilling shaft deflection assembly for a drilling direction control device of the type comprising a rotatable drilling shaft and a housing for rotatably supporting a length of the drilling shaft for rotation therein, wherein the drilling shaft deflection assembly is contained within the housing and is axially located between a first support location and a second support location, for bending the drilling shaft between the first support location and the second support location, and wherein the deflection assembly comprises:

(a) a deflection mechanism for imparting lateral movement to the drilling shaft in order to bend the drilling shaft;

(b) a deflection actuator for actuating the deflection mechanism in response to longitudinal movement of the deflection actuator; and (c) a deflection linkage mechanism between the deflection mechanism and the deflection actuator for converting longitudinal movement of the deflection actuator to lateral movement of the drilling shaft.

The drilling shaft deflection assembly as described above may encompass a variety of embodiments. The essence of the drilling shaft deflection assembly in all of the embodiments of the invention is the use of the longitudinally movable deflection actuator to effect lateral movement of the drilling shaft via the deflection linkage mechanism.

The drilling direction control device as described above may be further comprised of an indexing assembly for orienting the bend in the drilling shaft. Where an indexing assembly is provided, it may be integrated with the drilling shaft deflection assembly or it may be comprised of a separate apparatus.

The drilling direction control device as described above may be further comprised of a housing locking assembly for selectively engaging the housing with the drilling shaft so that they rotate together.

The drilling direction control device as described above may be further comprised of a housing orientation sensor apparatus for sensing the orientation of the housing.

The drilling shaft deflection assembly may be comprised of any structure or apparatus which includes a deflection mechanism for imparting lateral movement to the drilling shaft, a longitudinally movable deflection actuator for actuating the deflection mechanism, and a deflection linkage mechanism for converting longitudinal movement of the deflection actuator to lateral movement of the drilling shaft.

The deflection mechanism may be comprised of any structure or apparatus which is movable within the housing to impart lateral movement to the drilling shaft to bend the drilling shaft. The deflection mechanism may be movable by translation or by rotation, and may be movable in a plane which is either parallel with or perpendicular to the longitudinal axis of the drilling shaft.

The deflection actuator may be comprised of any structure or apparatus which is longitudinally movable within the housing to actuate the deflection mechanism and which is compatible with the deflection mechanism.

The deflection actuator is preferably further comprised of a power source for effecting longitudinal movement of the deflection actuator. The power source may be comprised of any structure or apparatus which can effect longitudinal movement of the deflection actuator.

For example, the power source may be comprised of hydraulic pressure exerted directly on the deflection actuator by drilling fluid being passed through the drilling direction control device. Preferably the power source is comprised of a hydraulic system contained within the housing. Preferably the hydraulic system is comprised of an annular pump which is driven by rotation of the drilling shaft. Preferably the hydraulic fluid is comprised of an oil. Preferably the hydraulic system is also comprised of a reciprocating hydraulic piston in a cylinder. Preferably the hydraulic system is double acting so that the power source operates to effect longitudinal movement of the deflection actuator in two directions. Preferably the annular pump is a gear pump which is driven by rotation of the drilling shaft.

The deflection linkage mechanism may be comprised of any structure or apparatus which is capable of converting longitudinal movement of the deflection actuator to lateral movement of the drilling shaft. As a result, the deflection linkage mechanism must be compatible with both the deflection mechanism and the deflection actuator.

In a first preferred embodiment of drilling shaft deflection assembly, the deflection mechanism may be comprised of an outer ring which is rotatably supported on a circular inner peripheral surface within the housing and which has a circular inner peripheral surface which is eccentric with respect to the housing, and an inner ring which is rotatably supported on the circular inner peripheral surface of the outer ring and which has a circular inner peripheral surface which engages the drilling shaft and which is eccentric with respect to the circular inner peripheral surface of the outer ring. The outer ring and the inner ring are capable of rotation relative to each other in a plane which is perpendicular to the longitudinal axis of the drilling shaft in order to impart lateral movement to the drilling shaft. Preferably the outer ring and the inner ring are both rotatable relative to the housing but are not movable longitudinally to any material extent.

In the first preferred embodiment of drilling shaft deflection assembly, the deflection actuator is comprised of a longitudinally movable cam device.

In the first preferred embodiment of drilling shaft deflection assembly the deflection linkage mechanism is comprised of a first track associated with the cam device for engaging a first deflection linkage member and a second track associated with the cam device for engaging a second deflection linkage member, both through complementary engagement surfaces. At least one of the first track and the second track is a spiral track so that the deflection linkage members will rotate relative to each other upon longitudinal movement of the cam device. Preferably the first track and the second track are opposing spiral tracks so that the deflection linkage members will rotate in opposite directions upon longitudinal movement of the cam device.

In the first preferred embodiment of drilling shaft deflection assembly, the cam device is comprised of a tubular sleeve cam which reciprocates within the housing, and the first deflection linkage member and the second deflection linkage member are both telescopically and rotatably received within the sleeve cam.

In the first preferred embodiment of drilling shaft deflection assembly, the deflection linkage mechanism is further comprised of the first deflection linkage member and the second deflection linkage member. The first deflection linkage member is connected with the outer ring and the second deflection linkage member is connected with the inner ring so that rotation of the first and second deflection linkage members will result in rotation of the outer ring and the inner ring respectively.

In a second preferred embodiment of drilling shaft deflection assembly the deflection mechanism is comprised of a camming surface associated with an inner surface of the housing and a follower member which is laterally movable between the housing and the drilling shaft. The camming surface and the follower member take the place of the outer ring and the inner ring of the first preferred embodiment. The camming surface and the follower member are capable of rotation relative to each other in a plane which is perpendicular to the longitudinal axis of the drilling shaft so that lateral movement of the follower member caused by the camming surface results in lateral movement of the drilling shaft. Preferably neither the camming surface nor the follower member is movable longitudinally to any material extent.

In the second preferred embodiment of the drilling shaft deflection assembly, as in the first preferred embodiment, the deflection actuator is comprised of a longitudinally movable rotary cam device.

In the second preferred embodiment of drilling shaft deflection assembly, the deflection linkage mechanism is comprised of a first track associated with the cam device for engaging a first deflection linkage member and may be comprised of a second track associated with the cam device for engaging a second deflection linkage member, both through complementary engagement surfaces. At least one of the first track and the second track is a spiral track so that the linkage members will rotate relative to each other upon longitudinal movement of the cam device.

In the second preferred embodiment of drilling shaft deflection assembly, the cam device is comprised of a tubular sleeve cam which reciprocates within the housing, and the deflection linkage member or members are telescopically and rotatably received within the sleeve cam.

In the second preferred embodiment of drilling shaft deflection assembly, the deflection linkage mechanism is further comprised of the deflection linkage member or members. The first deflection linkage member may be connected with one of the camming surface and the follower member and the second deflection linkage member may be connected with the other of the camming surface and the follower member so that rotation of the first and second deflection linkage members will result in relative rotation of the camming surface and the follower member.

In the second preferred embodiment of drilling shaft deflection assembly, the position of the camming surface will determine the orientation of the bend in the drilling shaft, while the relative positions of the camming surface and the follower member will determine the magnitude of the drilling shaft deflection. The deflection mechanism may therefore be actuated by rotation of the camming surface and the follower member relative to each other, while indexing of the deflection mechanism to attain a desired toolface orientation may be achieved by coordinated rotation together of the camming surface and the follower member. As a result, the second track and the second deflection linkage member may be omitted if the sole function of the deflection assembly is to deflect the drilling shaft without providing an indexing function.

In a third preferred embodiment of drilling shaft deflection assembly, the deflection mechanism is comprised of at least one laterally movable follower member which is disposed between the housing and the drilling shaft. Preferably the deflection mechanism is comprised of either a plurality of follower members or a single follower member with a plurality of follower member surfaces for engaging a plurality of camming surfaces. The follower member and the follower member surfaces may be of any shape and configuration which is compatible with the deflection actuator. The follower member engages the drilling shaft either directly or indirectly so that lateral movement of the follower member results in lateral movement of the drilling shaft.

In the third preferred embodiment of drilling shaft deflection assembly, the deflection linkage mechanism is comprised of at least one camming surface associated with the deflection actuator which engages the follower member in order to convert longitudinal movement of the deflection actuator to lateral movement of the follower member between the housing and the drilling shaft. Preferably the camming surface is longitudinally movable by the deflection actuator and preferably the follower member is not capable of longitudinal movement to any material extent. Preferably the follower member or members and their associated camming surfaces are comprised of complementary ramp surfaces.

Preferably the deflection actuator is comprised of a deflection actuator member and a power source for the deflection actuator. The deflection actuator member may be comprised of any longitudinally movable member. For example, the deflection actuator is preferably comprised of a hydraulic system and the deflection actuator member is preferably comprised of a reciprocating rod which is connected with both the camming surface and a hydraulic piston which is a component of the hydraulic system, so that reciprocation of the piston within a hydraulic cylinder results in reciprocation of the deflection actuator member and the camming surface.

In the third preferred embodiment of drilling shaft deflection assembly, the deflection assembly may impart lateral movement to the drilling shaft along a single axis or along a plurality of axes.

For uni-axial bending of the drilling shaft, the deflection assembly may be comprised of a single follower member and associated camming surface, or may be comprised of one or more follower members and associated camming surfaces which are separated by 180 degrees around the drilling shaft, thus providing additional support for the drilling shaft as it is being bent. Where a single follower member is used with a plurality of camming surfaces, the follower member preferably includes a plurality of follower member surfaces.

For multi-axial bending of the drilling shaft, the deflection assembly may be comprised of multiple deflection assemblies as described above for uni-axial bending, in which the multiple deflection assemblies are spaced radially about the drilling shaft. Preferably, the deflection assemblies are evenly spaced about the drilling shaft so that in the case of bi-axial bending the deflection assemblies are separated by about 90 degrees.

The multiple deflection assemblies may include a single follower member with a plurality of follower member surfaces or may include a plurality of follower members. Most preferably the deflection assembly is comprised of a single follower member with a plurality of follower member surfaces in the case of both uni-axial and multi-axial bending of the drilling shaft.

In the case of multi-axial bending of the drilling shaft, the follower member, the follower member surfaces and the camming surfaces preferably accommodate forced lateral movement of the follower member which results from movement of the follower member in more than one plane. Preferably this forced lateral movement is accommodated by allowing for movement of the camming surfaces relative to the follower member surfaces which is not parallel to the direction of movement required to actuate the deflection mechanism.

The drilling direction control device preferably includes an indexing assembly for orienting the bend in the drilling shaft so that the device may be used to provide directional control during drilling operations. The indexing assembly may be integrated with the drilling shaft deflection assembly or it may be comprised of a separate apparatus.

For example, the indexing assembly may be comprised of providing the deflection mechanism with the capability of bending the drilling shaft in a controlled manner in a plurality of directions (i.e., biaxial or multiaxial bending of the drilling shaft such as, for example, that provided by the drilling shaft deflection assembly described in U.S. Pat. No. 6,244,361 B1 (Halliburton Energy Services, Inc.)).

Alternatively, the indexing assembly may be comprised of an apparatus for orienting a bend in the drilling shaft (i.e., the toolface) by rotating one or both of the deflection mechanism and the housing. If the deflection mechanism has a fixed orientation relative to the housing, then the bend may be oriented by rotating both of the deflection mechanism and the housing, since they will rotate together. If the deflection mechanism and the housing do not have a fixed orientation relative to each other, then the bend must be oriented by rotating the deflection mechanism. In either case, the indexing assembly may utilize components of the deflection assembly or it may be independent of the deflection assembly.

Preferably the indexing assembly is comprised of an indexing mechanism for imparting rotational movement to the deflection mechanism, an indexing actuator for actuating the indexing mechanism in response to longitudinal movement of the indexing actuator, and an indexing linkage mechanism between the indexing mechanism and the indexing actuator for converting longitudinal movement of the indexing actuator to rotational movement of the deflection mechanism.

The indexing mechanism may be comprised of any structure or apparatus which is capable of imparting rotation to the deflection mechanism. The indexing actuator may be comprised of any longitudinally movable structure or apparatus which is capable of actuating the indexing mechanism through the indexing linkage mechanism. The indexing linkage mechanism may be comprised of any structure or apparatus which is capable of converting the longitudinal movement of the indexing actuator to rotational movement of the deflection mechanism.

The indexing actuator is preferably further comprised of a power source. The power source may be comprised of the flow of drilling fluid through the drilling direction control device. Preferably, however, the indexing actuator is comprised of an independent power source, such as a pump, a motor, or a pump/motor combination. Preferably the power source is comprised of a hydraulic system. Preferably the hydraulic system includes a reciprocating hydraulic piston in a cylinder. Preferably the hydraulic system further comprises a hydraulic pump for supplying hydraulic fluid to the cylinder. Preferably the hydraulic system is double acting so that the indexing actuator can be driven in two directions. The hydraulic pump may be powered by any suitable motor or device. Preferably the hydraulic pump is powered by the rotation of the drilling shaft. Preferably the hydraulic pump is an annular pump such as a gear pump. The power source for the indexing assembly may be the same power source that powers the deflection assembly or it may be a separate power source.

In a first preferred embodiment of indexing assembly, the indexing assembly is comprised of an apparatus similar to that utilized in the Sperry-Sun Drilling Services Coiled Tubing BHA Orienter. The Sperry-Sun Drilling Services Coiled Tubing BHA Orienter is described in a Technology Update published by Sperry-Sun Drilling Services in Winter 1995, which Technology Update is hereby incorporated by reference into this Specification.

Specifically, in the first preferred embodiment of indexing assembly, the indexing mechanism is comprised of a ratchet mechanism which selectively interlocks the deflection mechanism and the indexing linkage mechanism for rotation of the deflection mechanism in a single direction, the indexing actuator is comprised of a longitudinally movable piston, and the indexing linkage mechanism is comprised of a barrel cam device which converts longitudinal movement of the piston to rotation of the deflection mechanism.

In the first preferred embodiment of indexing assembly, the indexing linkage mechanism is further comprised of a helical groove in the barrel cam and a pin on the housing which engages the helical groove so that the barrel cam will rotate relative to the housing as the pin travels the length of the helical groove.

In the first preferred embodiment of indexing assembly, the indexing actuator is further comprised of a hydraulic system as a power source. Preferably the hydraulic system includes a reciprocating hydraulic piston in a cylinder. Preferably the hydraulic system further comprises a hydraulic pump for supplying hydraulic fluid to the cylinder. Preferably the hydraulic pump is powered by the rotation of the drilling shaft. Preferably the hydraulic system is double acting. The power source for the indexing assembly may be the same power source that powers the deflection assembly or it may be a separate power source.

The first preferred embodiment of indexing assembly may be easily adapted for use with any of the embodiments of deflection assembly. A second preferred embodiment of indexing assembly is intended for use specifically with the first and second preferred embodiments of deflection assembly, since it is integrated with the first and second preferred embodiments of deflection assembly.

In the second preferred embodiment of indexing assembly, the indexing mechanism is comprised of components of the deflection mechanism of either the first or second preferred embodiment of deflection assembly, the indexing actuator is comprised of components of the deflection actuator of either the first or second preferred embodiment of deflection assembly, and the indexing linkage mechanism is comprised of components of the deflection linkage mechanism of either the first or second embodiment of deflection assembly.

In the second preferred embodiment of indexing assembly, once the drilling shaft has been bent by the deflection assembly, simultaneous rotation of the deflection assembly as a unit will serve to orient the direction of the bend in the drilling shaft. This result is achieved by designing the tracks in the cam device which comprise the indexing linkage mechanism so that the indexing linkage mechanism will rotate the entire deflection mechanism at the same rate in response to longitudinal movement of the deflection actuator.

This result may in turn be achieved by designing the tracks in the cam device in two contiguous segments. A deflection segment of the tracks is utilized for bending of the drilling shaft while an indexing segment of the tracks is utilized for orientation of the bend in the drilling shaft. In the deflection segment the deflection linkage mechanism causes the components of the deflection mechanism to rotate at different rates and/or in different directions, while in the indexing segment the indexing linkage mechanism causes the components of the deflection mechanism to rotate together at the same rate and in the same direction.

In a third embodiment of indexing assembly, the deflection assembly facilitates multi-axial deflection of the drilling shaft and the indexing assembly is a component of the deflection assembly. The indexing assembly utilizes the multi-axial deflection of the drilling shaft to control the orientation of the bend in the drilling shaft.

For example, the indexing assembly could be comprised of the deflection assembly of either the first or second preferred embodiments of deflection assembly in which case the components of the deflection mechanism could be rotated independently to achieve both a desired deflection and a desired orientation of the bend in the drilling shaft.

A description of the manner in which the outer ring and the inner ring of the first preferred embodiment of deflection assembly could be rotated to achieve this result may be found in U.S. Pat. No. 6,244,361 B1. This system could easily be modified for use with the second preferred embodiment of deflection assembly.

As another example, the indexing assembly could be comprised of the deflection assembly of the third embodiment of deflection assembly in which multi-axial deflection is facilitated. In this case, selective deflection of the drilling shaft along more than one axis can be used to achieve a desired deflection and a desired orientation of the bend in the drilling shaft.

The third embodiment of indexing assembly is relatively complex, since it requires simultaneous deflection and indexing via the same apparatus. As a result, the third embodiment of indexing assembly is not preferred in circumstances where a relatively simple design for the drilling direction control device is desired.

The indexing assembly is preferably actuated with reference to the orientation of the housing. As a result, the drilling direction control device is preferably further comprised of a housing orientation sensor apparatus associated with the housing for sensing the orientation of the housing.

The housing orientation sensor apparatus may sense the orientation of the housing in three dimensions in space and may be comprised of any apparatus which is capable of providing this sensing function and the desired accuracy in sensing. The housing orientation sensor apparatus may therefore be comprised of one or more magnetometers, accelerometers or a combination of both types of sensing apparatus.

Alternatively, the housing orientation sensor apparatus may be designed more simply to sense the orientation of the housing relative only to gravity. In other words, the housing orientation sensor apparatus may be designed to sense only the orientation of the housing relative to the "high side" or the "low side" of the wellbore being drilled. In this case, the housing orientation sensor apparatus may be comprised of any gravity sensor or combination of gravity sensors, such as an accelerometer, a plumb bob or a rolling ball in a track.

Alternatively, the housing orientation sensor apparatus may be designed to sense the orientation of the housing relative only to the earth's magnetic field. In other words, the housing orientation sensor apparatus may be designed to sense only the orientation of the housing relative to magnetic north. In this case, the housing orientation sensor apparatus may be comprised of any magnetic sensor or combination of magnetic sensors, such as a magnetometer.

The housing orientation sensing apparatus is preferably located as close as possible to the distal end of the housing so that the sensed orientation of the housing will be as close as possible to the distal end of the borehole during operation of the device. The housing orientation sensor apparatus is preferably contained in or associated with an at-bit-inclination (ABI) insert located inside the housing.

The drilling direction control device may also be further comprised of a deflection assembly orientation sensor apparatus associated with the deflection assembly for sensing the orientation of the deflection mechanism (and thus the orientation of the bend in the drilling shaft). Such a deflection assembly orientation sensor apparatus may provide for sensing directly the orientation of the deflection mechanism in one, two or three dimensions relative to gravity and/or the earth's magnetic field, in which case the deflection assembly orientation sensor apparatus may possibly eliminate the need for the housing orientation sensor apparatus.

Preferably, however the deflection assembly orientation sensor apparatus senses the orientation of the deflection mechanism relative to the housing and may be comprised of any apparatus which is capable of providing this sensing function and the desired accuracy in sensing.

Alternatively, the deflection assembly may be designed to be fixed relative to the housing so that the bend in the drilling shaft is always located at a known orientation relative to the housing (i.e., at a "theoretical high side"). In this case, the orientation of the bend in the drilling shaft will be determinable from the orientation of the housing and only one of a housing orientation sensor apparatus and a deflection assembly orientation sensor apparatus will be required.

Embodiments of suitable housing orientation sensor apparatus and deflection assembly orientation sensor apparatus are described in U.S. Pat. No. 6,244,361 B1.

A preferred embodiment of housing orientation sensor apparatus which could also be adapted for use as a deflection assembly orientation sensor apparatus and which is not described in U.S. Pat. No. 6,244,361 B1 senses the orientation of the apparatus relative to gravity.

In the preferred embodiment of housing orientation sensor apparatus, the apparatus is comprised of:

(a) a housing reference indicator which is fixedly connected with the housing at a housing reference position;

(b) a circular track surrounding the drilling shaft, which circular track houses a metallic gravity reference indicator which moves freely about the circular track in response to gravity, for providing a gravity reference position;

(c) a proximity assembly associated with and rotatable with the drilling shaft, which proximity assembly includes a housing reference sensor and a gravity reference sensor, wherein the housing reference sensor and the gravity reference sensor have a fixed proximity to each other.

In operation, the proximity assembly rotates as the drilling shaft rotates. As the housing reference sensor passes the housing reference indicator it will sense the housing reference indicator. Similarly, as the gravity reference sensor passes the gravity reference indicator it will sense the gravity reference indicator. Due to the known proximity between the housing reference sensor and the gravity reference sensor, the orientation of the housing relative to gravity can be determined from the sensed data.

The housing reference indicator may be comprised of any structure or apparatus which is compatible with the housing reference sensor. In the preferred embodiment the housing reference indicator is comprised of one or more magnets and the housing reference sensor is comprised of one or more Hall Effect sensors.

The gravity reference indicator may be comprised of any structure or apparatus which will move about the circular track in response to gravity and which can be sensed by the gravity reference sensor. In the preferred embodiment the gravity reference indicator is comprised of a movable metallic weight and the gravity reference sensor is comprised of a magnetic proximity sensor which is capable of sensing metal. Most preferably the gravity reference indicator is comprised of a metallic ball which is free to roll about the circular track.

The drilling direction control device may be further comprised of a housing locking assembly for selectively engaging the housing with the drilling shaft so that they rotate together. This feature is advantageous for applying torque to the housing to dislodge it from a wellbore in which it has become stuck.

The housing locking assembly may be comprised of any structure or apparatus which is capable of engaging the drilling shaft with the housing so that they rotate together. Preferably the housing locking assembly may be selectively actuated both to engage and disengage the drilling shaft and the housing. Alternatively, the housing locking assembly may be actuatable only to engage the drilling shaft and the housing so that the drilling direction control device must be removed from the wellbore in order to disengage the drilling shaft and the housing.

Preferably the housing locking assembly is comprised of a housing locking mechanism for engaging the drilling shaft with the housing and a housing locking actuator for actuating the housing locking mechanism.

The housing locking mechanism may be comprised of any structure or apparatus which is capable of engaging the drilling shaft and the housing such that they will rotate together. Preferably the housing locking mechanism is comprised of a locking member which is actuated to engage both the drilling shaft and the housing. Preferably the housing locking mechanism is longitudinally movable between positions where the drilling shaft and the housing are engaged and disengaged.

The housing locking actuator may be comprised of any structure or apparatus which is capable of actuating the housing locking mechanism. Preferably the housing locking actuator moves longitudinally in order to actuate the housing locking mechanism. Preferably longitudinal movement of the housing locking actuator results in longitudinal movement of the housing locking mechanism and thus actuation of the housing locking assembly.

In a preferred embodiment of housing locking assembly, the housing locking mechanism is comprised of a longitudinally movable locking sleeve and the housing locking actuator is comprised of a longitudinally movable locking actuator member.

In the preferred embodiment of housing locking assembly, the housing locking mechanism is further comprised of complementary engagement surfaces on each of the drilling shaft, the housing and the locking sleeve so that when the locking sleeve is actuated to engage the drilling shaft and the housing, the engagement surfaces on each of the drilling shaft, the housing and the locking sleeve are brought into engagement.

The complementary engagement surfaces may be comprised of any suitable surface which will provide the necessary engagement function. Preferably the complementary engagement surfaces are comprised of splines, but may also be comprised of a non-circular cross-sectional shape of the drilling shaft, housing and locking sleeve, such as a square or octagonal cross-sectional shape.

In the preferred embodiment of housing locking mechanism, the housing locking actuator is preferably further comprised of a power source. The power source may be comprised of the flow of drilling fluid through the drilling direction control device. Preferably, however, the housing locking actuator is comprised of an independent power source, such as a pump, a motor, or a pump/motor combination. Preferably the power source is comprised of a hydraulic system. Preferably the hydraulic system includes a reciprocating hydraulic piston in a cylinder. Preferably the hydraulic system further comprises a hydraulic pump for supplying hydraulic fluid to the cylinder. The hydraulic pump may be powered by any suitable motor or device. Preferably the hydraulic pump is powered by the rotation of the drilling shaft. Preferably the hydraulic pump is comprised of an annular pump such as a gear pump.

Preferably the hydraulic system is double acting so that the housing locking assembly can be actuated both to engage and disengage the drilling shaft and the housing.

A single power source may be provided as the power source for each of the deflection assembly, the indexing assembly and the housing locking assembly. Alternatively, one or each of the assemblies may be provided with its own dedicated power source.

Furthermore, a single actuator may be provided as a deflection actuator, an indexing actuator and a housing locking actuator. Alternatively, one or each of the assemblies may be provided with its own dedicated actuator.

BRIEF DESCRIPTION OF DRAWINGS

Embodiments of the invention will now be described with reference to the accompanying drawings, in which:

FIG. 1(*b*) is a schematic partial cut-away side view of an alternate preferred embodiment of a drilling direction control device, not including a near-bit stabilizer.

FIG. 7(*a*) through FIG. 7(*m*) are longitudinal cross-section assembly views of a drilling direction control device incorporating a first version of a third preferred embodiment of drilling shaft deflection assembly, with FIG. 7(*b*) being a continuation of FIG. 7(*a*), and so on.

DETAILED DESCRIPTION

The within invention is comprised of improvements in a drilling direction control device (20). The device (20) permits directional control over a drilling bit (22) connected with the device (20) during rotary drilling operations by controlling the deflection of the drilling bit (22). As a result, the direction of the resulting wellbore may be controlled.

In particular, the invention relates to improvements in a drilling shaft deflection assembly for bending a drilling shaft and in an indexing assembly for orienting the direction of the bend in a drilling shaft to provide a desired toolface.

Figure 1A:
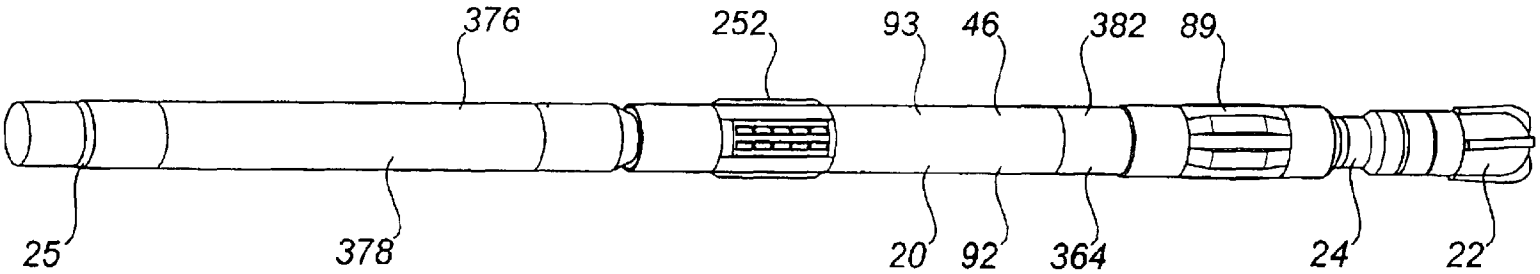
FIG. 1(*a*) is a schematic side view of a first preferred embodiment of a drilling direction control device comprising a rotary drilling system, including a near-bit stabilizer.
Figure 1B:
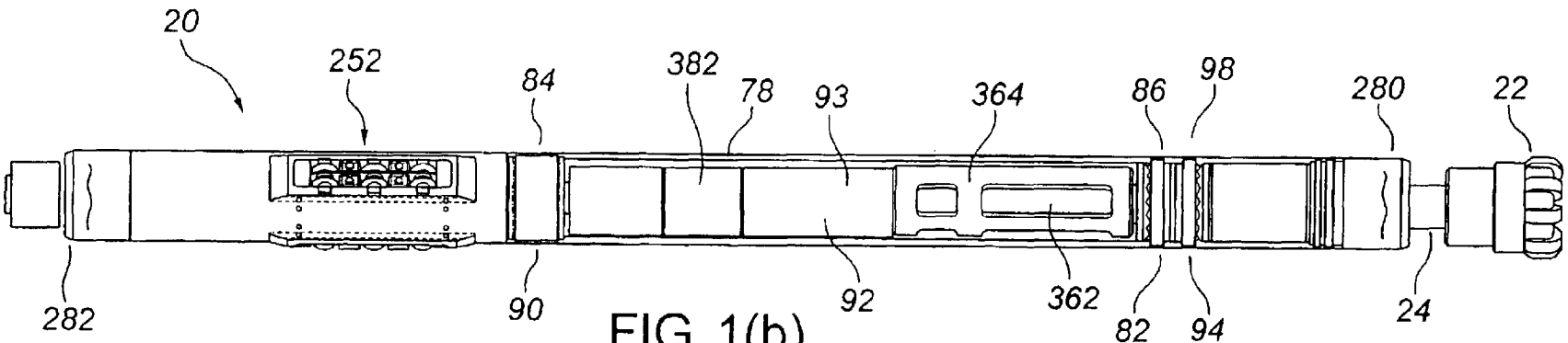
Figure 2:
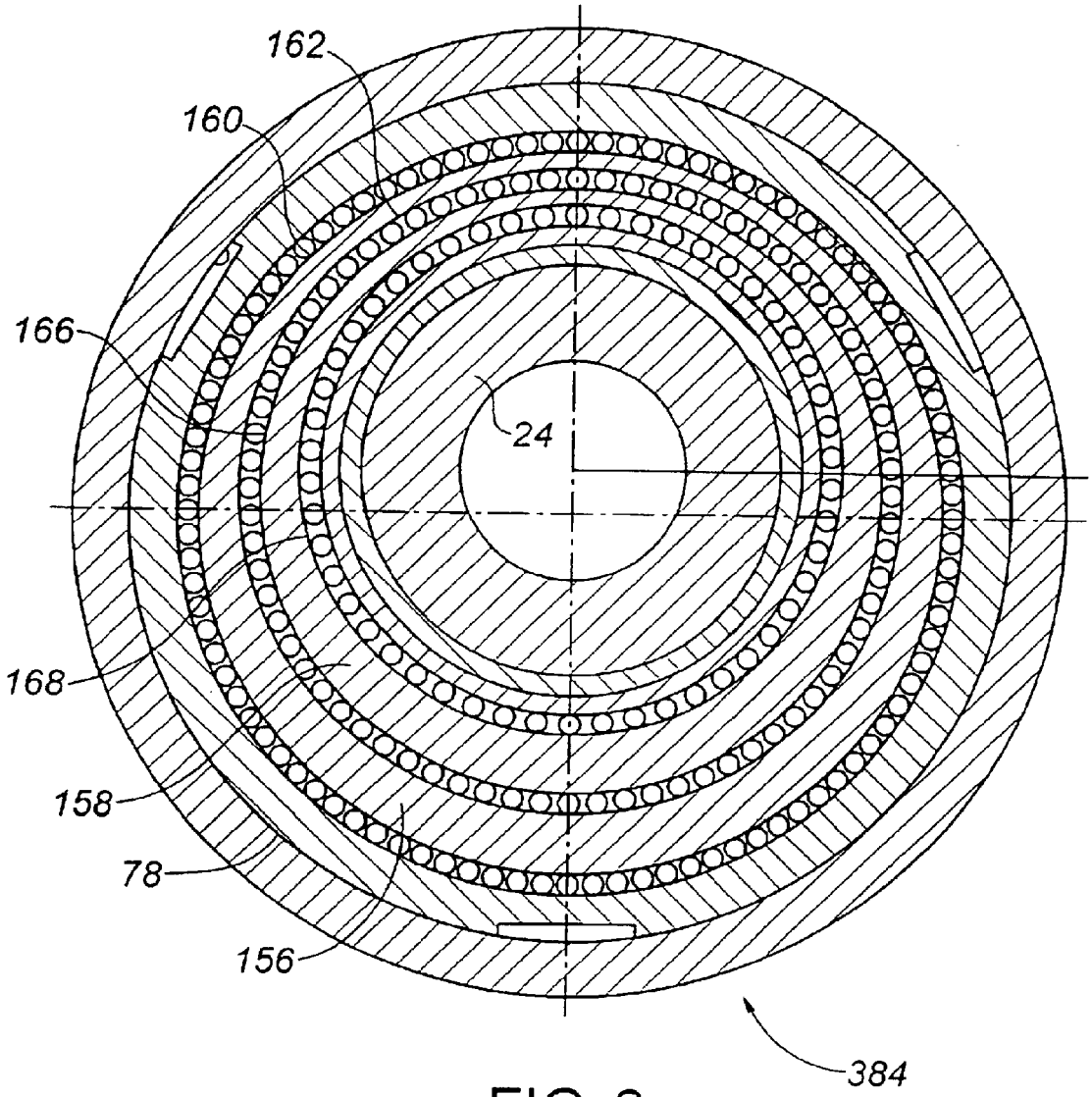
FIG. 2 is a transverse cross-section view of a deflection mechanism for a first preferred embodiment of drilling shaft deflection assembly, including a rotatable outer ring and a rotatable inner ring.

1. General Description of the Drilling Direction Control Device (20) (FIGS. 1,2,7)

The invention is particularly suited for use with a drilling direction control device of the type described in U.S. Pat. No. 6,244,361 B1 (Halliburton Energy Services, Inc.), with the result that many of the components of the drilling direction control device described in U.S. Pat. No. 6,244,361 B1 may be used with the drilling direction control device of the present invention.

The drilling direction control device (20) is comprised of a rotatable drilling shaft (24) which is connectable or attachable to a rotary drilling bit (22) and to a rotary drilling string (25) during the drilling operation. More particularly, the drilling shaft (24) has a proximal end (26) and a distal end (28). The proximal end (26) is drivingly connectable or attachable with the rotary drilling string (25) such that rotation of the drilling string (25) from the surface results in a corresponding rotation of the drilling shaft (24). The proximal end (26) of the drilling shaft (24) may be permanently or removably attached, connected or otherwise affixed with the drilling string (25) in any manner and by any structure, mechanism, device or method permitting the rotation of the drilling shaft (24) upon the rotation of the drilling string (25).

Preferably, the device (20) is further comprised of a drive connection (29) for connecting the drilling shaft (24) with the drilling string (25). The drive connection (29) may be comprised of any structure, mechanism or device for drivingly connecting the drilling shaft (24) and the drilling string (25) so that rotation of the drilling string (25) results in a corresponding rotation of the drilling shaft (24).

Similarly, the distal end (28) of the drilling shaft (24) is drivingly connectable or attachable with the rotary drilling bit (22) such that rotation of the drilling shaft (24) by the drilling string (25) results in a corresponding rotation of the drilling bit (22). The distal end (28) of the drilling shaft (24) may be permanently or removably attached, connected or otherwise affixed with the drilling bit (22) in any manner and by any structure, mechanism, device or method permitting the rotation of the drilling bit (22) upon the rotation of the drilling shaft (24). In the preferred embodiment, a threaded connection is provided therebetween.

The drilling shaft (24) may be comprised of one or more elements or portions connected, attached or otherwise affixed together in any suitable manner providing a unitary drilling shaft (24) between the proximal and distal ends (26, 28). Preferably, any connections provided between the elements or portions of the drilling shaft (24) are relatively rigid such that the drilling shaft (24) does not include any flexible joints or articulations therein. In the preferred embodiment, the drilling shaft (24) is comprised of a single, unitary or integral element extending between the proximal and distal ends (26, 28). Further, the drilling shaft (24) is tubular or hollow to permit drilling fluid to flow therethrough in a relatively unrestricted or unimpeded manner.

Finally, the drilling shaft (24) may be comprised of any material suitable for and compatible with rotary drilling. In the preferred embodiment, the drilling shaft (24) is comprised of high strength stainless steel.

Further, the device (20) is comprised of a housing (46) for rotatably supporting a length of the drilling shaft (24) for rotation therein upon rotation of the attached drilling string (25). The housing (46) may support, and extend along, any length of the drilling shaft (24). However, preferably, the housing (46) supports substantially the entire length of the drilling shaft (24) and extends substantially between the proximal and distal ends (26, 28) of the drilling shaft (24).

In the preferred embodiment, the housing (46) has a proximal end (48) adjacent or in proximity to the proximal end (26) of the drilling shaft (24). Specifically, the proximal end (26) of the drilling shaft (24) extends from the proximal end (48) of the housing (46) for connection with the drilling string (25). However, in addition, a portion of the adjacent drilling string (25) may extend within the proximal end (48) of the housing (46). Similarly, in the preferred embodiment, the housing (46) has a distal end (50) adjacent or in proximity to the distal end (28) of the drilling shaft (24). Specifically, the distal end (28) of the drilling shaft (24) extends from the distal end (50) of the housing (46) for connection with the drilling bit (22).

The housing (46) may be comprised of one or more tubular or hollow elements, sections or components permanently or removably connected, attached or otherwise affixed together to provide a unitary or integral housing (46) permitting the drilling shaft (24) to extend therethrough.

The device (20) is further comprised of at least one distal radial bearing (82) which is contained within the housing (46) for rotatably supporting the drilling shaft (24) radially at a distal radial bearing location (86) defined thereby.

The distal radial bearing (82) is comprised of a fulcrum bearing (88), also referred to as a focal bearing, or some other bearing which facilitates the pivoting of the drilling shaft (24) at the distal radial bearing location (86) upon the controlled deflection of the drilling shaft (24) by the device (20) to produce a bending or curvature of the drilling shaft (24) in order to orient or direct the drilling bit (22).

The device (20) may optionally be further comprised of a near bit stabilizer (89), preferably located adjacent to the distal end (50) of the housing (46) and preferably coinciding with the distal radial bearing location (86). The near bit stabilizer (89) may be comprised of any type of stabilizer and may be either adjustable or non-adjustable.

The device (20) is further comprised of at least one proximal radial bearing (84) which is contained within the housing (46) for rotatably supporting the drilling shaft (24) radially at a proximal radial bearing location (90) defined thereby.

The proximal radial bearing (84) may be comprised of any radial bearing able to rotatably radially support the drilling shaft (24) within the housing (46) at the proximal radial bearing location (90), but the proximal radial bearing (84) is preferably comprised of a cantilever bearing.

Upon deflection of the drilling shaft (24) by the device (20), as described further below, the curvature or bending of the drilling shaft (24) is produced downhole of the cantilever proximal radial bearing (84). In other words, the deflection of the drilling shaft (24), and thus the curvature of the drilling shaft (24), occurs between the proximal radial bearing location (90) and the distal radial bearing location (86). The cantilever nature of the proximal radial bearing (84) inhibits the bending of the drilling shaft (24) uphole or above the proximal radial bearing (84). The fulcrum bearing comprising the distal radial bearing (82) facilitates the pivoting of the drilling shaft (24) and permits the drilling bit (22) to tilt in any desired direction. Specifically, the drilling bit (22) is permitted to tilt in the opposite direction of the bending direction.

The device (20) is further comprised of a drilling shaft deflection assembly (92) contained within the housing (46) for bending the drilling shaft (24) therein. The drilling shaft deflection assembly (92) is located axially at a location between the distal radial bearing location (86) and the proximal radial bearing location (90) so that the deflection assembly (92) bends the drilling shaft (24) between the distal radial bearing location (86) and the proximal radial bearing location (90). Various embodiments of the drilling shaft deflection assembly (92) are described in detail below.

The device (20) may also be further comprised of an indexing assembly (93) contained within the housing (46) for orienting the deflection mechanism to provide a desired toolface. The indexing assembly (93) may be integrated with the deflection assembly (92) or it may be comprised of a separate apparatus. Various embodiments of the indexing assembly (93) are described in detail below.

In addition to the radial bearings (82, 84) for rotatably supporting the drilling shaft (24) radially, the device (20) further preferably includes one or more thrust bearings for rotatably supporting the drilling shaft (24) axially.

Preferably, the device (20) is comprised of at least one distal thrust bearing (94) and at least one proximal thrust bearing (96). The thrust bearings (94, 96) may be positioned at any locations along the length of the drilling shaft (24) permitting the bearings (94, 96) to rotatably support the drilling shaft (24) axially within the housing (46).

Preferably, at least one distal thrust bearing (94) is located axially at a distal thrust bearing location (98) which is preferably located axially between the distal end (50) of the housing (46) and the deflection assembly (92). The distal thrust bearing (94) may be comprised of any suitable thrust bearing but is preferably comprised of the fulcrum bearing (88) described above so that the distal thrust bearing location (98) is at the distal radial bearing location (86).

Preferably at least one proximal thrust bearing (96) is located axially at a proximal thrust bearing location (100) which is preferably located axially between the proximal end (48) of the housing (46) and the deflection assembly (92). Most preferably the proximal thrust bearing location (100) is located axially between the proximal end (48) of the housing (46) and the proximal radial bearing location (90). The proximal thrust bearing (96) may be comprised of any suitable thrust bearing.

As a result of the thrust bearings (94, 96), most of the weight on the drilling bit (22) may be transferred into and through the housing (46) as compared to through the drilling shaft (24) of the device (20). Thus, the drilling shaft (24) may be permitted to be slimmer and more controllable. As well, most of the drilling weight bypasses the drilling shaft (24) substantially between its proximal and distal ends (48, 50) and thus bypasses the other components of the device (20) including the deflection assembly (92). More particularly, weight applied on the drilling bit (22) through the drill string (25) is transferred, at least in part, from the drilling string (25) to the proximal end (48) of the housing (46) by the proximal thrust bearing (96) at the proximal thrust bearing location (100). The weight is further transferred, at least in part, from the distal end (50) of the housing (46) to the drilling shaft (24), and thus the attached drilling bit (22), by the fulcrum bearing (88) at the distal thrust bearing location (100).

The thrust bearings (94, 96) are preferably preloaded. Any mechanism, structure, device or method capable of preloading the thrust bearings (94, 96) may be utilized.

Due to rotation of the drilling shaft (24) during rotary drilling, there will be a tendency for the housing (46) to rotate during the drilling operation. As a result, the device (20) is preferably comprised of an anti-rotation device (252) associated with the housing (46) for restraining rotation of the housing (46) within the wellbore. Any type of anti-rotation device (252) or any mechanism, structure, device or method capable of restraining or inhibiting the tendency of the housing (46) to rotate upon rotary drilling may be used. Further, one or more such devices (252) may be used as necessary to provide the desired result.

As well, the device (252) may be associated with any portion of the housing (46). In other words, the anti-rotation device (252) may be located at any location or position along the length of the housing (46) between its proximal and distal ends (48, 50). The anti-rotation device (252) may be associated with the housing (46) in any manner permitting the functioning of the device (252) to inhibit or restrain rotation of the housing (46).

In addition, the drilling direction control device (20) is preferably further comprised of one or more seals or sealing assemblies for sealing the distal and proximal ends (50, 48) of the housing (46) such that the components of the device (20) located therebetween are not exposed to various drilling fluids, such as drilling mud. In addition to inhibiting the entrance of drilling fluids into the device (20) from outside, the seals or sealing assemblies also facilitate the maintenance or retention of desirable lubricating fluids within the device (20).

Preferably, the device (20) is comprised of a distal seal or sealing assembly (280) and a proximal seal or sealing assembly (282). The distal seal (280) is radially positioned and provides a rotary seal between the housing (46) and the drilling shaft (24) at, adjacent or in proximity to the distal end (50) of the housing (46).

The proximal seal (282) is radially positioned and provides a rotary seal between the housing (46) and the drilling shaft (24) at, adjacent or in proximity to the proximal end (48) of the housing (46). However, where the drilling string (25) extends within the proximal end (48) of the housing (46), the proximal seal (282) is more particularly positioned between the housing (46) and the drilling string (25). Thus, the proximal seal (282) is radially positioned and provides a seal between the drilling shaft (24) or the drilling string (25) and the housing (46) at, adjacent or in proximity to the proximal end (48) of the housing.

As well, the interior of the housing (46) preferably defines a fluid chamber (284) between the distal and proximal ends (50, 48) of the housing (46). Thus, the fluid chamber (284) is positioned or defined between the distal and proximal seals (280, 282) associated with the distal and proximal ends (50, 48) of the housing (46) respectively. As indicated above, the fluid chamber (284) is preferably filled with a lubricating fluid for lubricating the components of the device (20) within the housing (46).

The distal and proximal seals (280, 282) are preferably mounted about the drilling shaft (24) and drilling string (25) respectively such that the drilling shaft (24) and attached drilling string (25) are permitted to rotate therein while maintaining the sealing. Further, the distal and proximal seals (280, 282) preferably provide a flexible sealing arrangement or flexible connection between the housing (46) and the drilling shaft (24) or drilling string (25) in order to maintain the seal provided thereby, while accommodating any movement or deflection of the drilling shaft (24) or drilling string (25) within the housing (46). This flexible connection is particularly important for the distal seal (280) which is exposed to the pivoting of the drilling shaft (24) by the deflection assembly (92). A suitable sealing arrangement is described in detail in U.S. Pat. No. 6,244,361 B1 (Halliburton Energy Services, Inc.).

The lubricating fluid contained within the fluid chamber (284) of the housing (46) between the proximal and distal seals (282, 280) has a pressure. Preferably, the device (20) is further comprised of a pressure compensation system (326) for balancing the pressure of the lubricating fluid contained in the fluid chamber (284) within the housing (46) with the ambient pressure outside of the housing (46). The pressure compensation system (326) may be located at any position or location along the length of the housing (46) between the distal and proximal seals (280, 282).

The pressure compensation system (326) may be comprised of any mechanism, device or structure capable of providing for or permitting the balancing of the pressure of the lubricating fluid contained in the fluid chamber (284) with the ambient pressure outside of the housing (46). Preferably, the pressure compensation system (326) is comprised of at least one pressure port (328) in the housing (46) so that the ambient pressure outside of the housing (46) can be communicated to the fluid chamber (284).

Preferably, the pressure of the lubricating fluid contained in the fluid chamber (284) of the housing (46) is maintained higher than the ambient pressure outside of the housing (46) or the annulus pressure in the wellbore. Specifically, the pressure compensation system (326) preferably internally maintains a positive pressure across the distal and proximal seals (280, 282). As a result, in the event there is any tendency for the distal and proximal seals (280, 282) to leak and permit the passage of fluid across the seals (280, 282), the passage of any such fluid will tend to be lubricating fluid from within the fluid chamber (284) to outside of the device (20).

In order to provide a pressure within the fluid chamber (284) of the housing (46) higher than the outside annulus pressure, the pressure compensation system (326) is further preferably comprised of a supplementary pressure source (330). The supplementary pressure source (330) exerts pressure on the lubricating fluid contained in the fluid chamber (284) so that the pressure of the lubricating fluid contained in the fluid chamber (284) is maintained higher than the ambient pressure outside of the housing (46). The pressure differential between the fluid chamber (284) and outside the housing (46) may be selected according to the expected drilling conditions. However, preferably, only a slightly positive pressure is provided in the fluid chamber (284) by the supplementary pressure source (330).

The supplementary pressure may be provided in any manner or by any method, and the supplementary pressure source (330) may be comprised of any structure, device or mechanism, capable of providing the desired supplementary pressure within the fluid chamber (284) to generate the desired pressure differential between the fluid chamber (284) and outside the housing (46).

Preferably the pressure compensation system (326) is further comprised of a balancing piston assembly (336) which includes a movable piston (340) contained within a piston chamber (338). The piston (340) separates the piston chamber (338) into a fluid chamber side (342) and a balancing side (344). The fluid chamber side (342) is connected with the fluid chamber (284) and is preferably located distally or downhole of the piston (340). The pressure port (328) communicates with the balancing side (344) of the piston chamber (338), which is preferably located proximally or uphole of the piston (340). Further, the supplementary pressure source (330) acts on the balancing side (344) of the piston chamber (338). Specifically, the supplementary pressure source (330) acts on the balancing side (344) by exerting the supplementary pressure on the piston (340).

Preferably the supplementary pressure source (330) is comprised of a biasing device located within the balancing side (344) of the piston chamber (338) and which exerts the supplementary pressure on the piston (340). The biasing device may be comprised of any device, structure or mechanism capable of biasing the piston (340) in the manner described above. Preferably the biasing device is comprised of a spring (346).

Preferably the device (20) has the capability to communicate electrical signals between two members which rotate relative to each other without having any contact therebetween. For example, this communication is required when downloading operating parameters for the device (20) or communicating downhole information from the device (20) either further uphole along the drilling string (25) or to the surface. Specifically, the electrical signals must be communicated between the drilling shaft (24) and the housing (46), which rotate relative to each other during the rotary drilling operation.

The communication link between the drilling shaft (24) and the housing (46) may be provided by any direct or indirect coupling or communication method or any mechanism, structure or device for directly or indirectly coupling the drilling shaft (24) with the housing (46). For instance, the communication between the housing (46) and the drilling shaft (24) may be provided by a slip ring or a gamma-at-bit communication toroid coupler. However, in the preferred embodiment, the communication between the drilling shaft (24) and the housing (46) is provided by an electromagnetic coupling device (350) between the housing (46) and the drilling shaft.

The deflection assembly (92) and the indexing assembly (93) may be actuated manually. Preferably, however, the device (20) is further comprised of a controller (360) for controlling the actuation of the drilling shaft deflection assembly (92) and the indexing assembly (93) to provide directional drilling control. The controller (360) of the device (20) is preferably associated with the housing (46) and is preferably comprised of an electronics insert positioned within the housing (46). Information or data provided by the various downhole sensors of the device (20) is communicated to the controller (360) in order that the deflection assembly (92) and the indexing assembly (93) may be actuated with reference to and in accordance with the information or data provided by the sensors.

The drilling direction control device (20) is preferably comprised of a housing orientation sensor apparatus (362) which is associated with the housing (46) for sensing the orientation of the housing (46) within the wellbore. Since the housing (46) is substantially restrained from rotating during drilling, the orientation of the housing (46) which is sensed by the housing orientation sensor apparatus (362) provides the reference orientation for the device (20).

The housing orientation sensor apparatus (362) may be comprised of any sensor or sensors, such as one or a combination of magnetometers and accelerometers, capable of sensing the orientation of the housing (46). The housing orientation sensor apparatus (362) is preferably located as close as possible to the distal end (50) of the housing (46). The housing orientation sensor apparatus (362) preferably senses the orientation of the housing (46) in three dimensions in space. Alternatively, the housing orientation sensor apparatus (362) may be designed to sense the orientation of the housing (46) in fewer than three dimensions. For example, the housing orientation sensor apparatus (362) may be designed to sense the orientation of the housing (46) relative to gravity and/or the earth's magnetic field. A preferred embodiment of housing orientation sensor apparatus (362) is described in detail below.

Preferably the housing orientation sensor apparatus (362) is contained within or is part of an ABI or at-bit-inclination insert associated with the housing (46). Preferably, the ABI insert (364) is connected or mounted with the housing (46) at, adjacent or in close proximity with its distal end (68). Referring to FIGS. 1(*a*) and 1(*b*), the ABI insert (364) is depicted as located distally of the deflection assembly (92). Referring to FIG. 7(*d*), the ABI insert (364) is depicted as located proximally of the deflection assembly (92). Either configuration is possible, with the preferred configuration depending upon the design of the deflection assembly (92), the indexing assembly (93) and the other components of the drilling direction control device (20).

The drilling direction control device (20) may also be comprised of a deflection assembly orientation sensor apparatus (366) associated with the deflection assembly (92) for sensing the orientation of the deflection mechanism. Alternatively the deflection mechanism may be designed to maintain a constant orientation relative to the housing (46) so that the orientation of the deflection mechanism can be determined from the orientation of the housing (46), thus eliminating the need for a separate deflection assembly orientation sensor apparatus (366).

Where provided, the deflection assembly orientation sensor apparatus (366) preferably senses the orientation of the deflection mechanism relative to the housing (46). However, the deflection assembly orientation sensor apparatus (366) may also sense the orientation of the deflection mechanism without reference to the orientation of the housing (46), in which case it may be possible to eliminate the housing orientation sensor apparatus (362).

The deflection assembly orientation sensor apparatus (366) may be comprised of any sensor or sensors, such as one or a combination of magnetometers and accelerometers, capable of sensing the position of the deflection assembly (92) in space or relative to the housing (46).

The controller (360) may also be operatively connected with a drilling string orientation sensor apparatus (376) so that the deflection assembly (92) and the indexing assembly (93) may further be actuated with reference to the orientation of the drilling string (25). The drilling string orientation sensor apparatus (376) is connected, mounted or otherwise associated with the drilling string (25). The controller (360) may be operatively connected with the drilling string orientation sensor apparatus (376) in any manner and by any mechanism, structure, device or method permitting or providing for the communication of information or data therebetween. However, preferably, the operative connection between the controller (360) and the drilling string orientation sensor apparatus (376) is provided by the electromagnetic coupling device (350).

The drilling string orientation sensor apparatus (376) may be comprised of any sensor or sensors, such as one or a combination of magnetometers and accelerometers, capable of sensing the orientation of the drilling string (25)). In addition, the drilling string orientation sensor apparatus (376) preferably senses the orientation of the drilling string (25) in three dimensions in space.

The deflection assembly (92) and the indexing assembly (93) are therefore preferably actuated to reflect a desired orientation of the drilling string (25) by taking into consideration the orientation of the drilling string (25), the orientation of the housing (46) and the orientation of the deflection assembly (92) relative to the housing (46).

As well, while drilling, the housing (46) may tend to slowly rotate in the same direction of rotation of the drilling shaft (24) due to the small amount of torque that is transmitted from the drilling shaft (24) to the housing (46). This motion causes the toolface of the drilling bit (22) to move out of the desired position. The various sensor apparatuses (362, 366, 376) may sense this change and communicate the information to the controller (360). The controller (360) preferably keeps the toolface of the drilling bit (22) on target by automatically adjusting the orientation of the deflection mechanism to compensate for the rotation of the housing (46).

In order that information or data may be communicated along the drilling string (25) from or to downhole locations, such as from or to the controller (360) of the device (20), the device (20) may be comprised of a drilling string communication system (378). More particularly, the drilling string orientation sensor apparatus (376) is also preferably operatively connected with the drilling string communication system (378) so that the orientation of the drilling string (25) may be communicated to an operator of the device (20). The operator of the device (20) may be either a person at the surface in charge or control of the drilling operations or may be comprised of a computer or other operating system for the device (20).

The drilling string communication system (378) may be comprised of any system able to communicate or transmit data or information from or to downhole locations. However, preferably, the drilling string communication system (378) is comprised of an MWD or Measurement-While-Drilling system or device.

The device (20) may be comprised of any further number of sensors as required or desired for any particular drilling operation, such as sensors for monitoring other internal parameters of the device (20).

The device (20) may be further comprised of a device memory (380) for storing data generated by one or more of the housing orientation sensor apparatus (362), the deflection assembly orientation sensor apparatus (366), the drilling string orientation sensor apparatus (376) or data obtained from some other source such as, for example an operator of the device (20). The device memory (380) is preferably associated with the controller (20), but may be positioned anywhere between the proximal and distal ends (48, 50) of the housing (46), along the drilling string (25), or may even be located outside of the borehole. During operation of the device (20), data may be retrieved from the device memory (380) as needed in order to control the operation of the device (20), including the actuation of the deflection assembly (92) and the indexing assembly (93).

Finally, the device (20) may be further comprised of a housing locking assembly (382) for selectively engaging the housing (46) with the drilling shaft (24) so that the drilling shaft (24) and the housing (46) will rotate together. This housing locking assembly (382) is particularly advantageous in circumstances where the housing (46) has become stuck in a wellbore, since the application of torque to the housing (46) via the drilling string (25) and the drilling shaft (24) may be sufficient to dislodge the housing (46). A preferred embodiment of housing locking assembly (382) is described in detail below.

2. Detailed Description of Deflection Assembly (92)

As indicated above, the device (20) includes a drilling shaft deflection assembly (92) contained within the housing (46), for bending the drilling shaft (24). The deflection assembly (92) may be comprised of any structure or apparatus capable of bending the drilling shaft (24) or deflecting the drilling shaft (24) laterally or radially within the housing (46) and having the following basic components:

(a) a deflection mechanism (384) for imparting lateral movement to the drilling shaft (24) in order to bend the drilling shaft (24);

(b) a deflection actuator (386) for actuating the deflection mechanism (384) in response to longitudinal movement of the deflection actuator (386); and (c) a deflection linkage mechanism (388) between the deflection mechanism (384) and the deflection actuator (386) for converting longitudinal movement of the deflection actuator (386) to lateral movement of the drilling shaft (24).

FIG. 7 depicts in detail a drilling direction control device (20) within the scope of the invention which includes a third preferred embodiment of deflection assembly (92). Regardless of the chosen design of deflection assembly (92), the components comprising the deflection assembly (92) may be located generally at the location of the deflection assembly (92) as depicted in FIG. 7(*c*), with minor modification to the device (20) as depicted in FIG. 7.

(a) First Preferred Embodiment of Deflection Assembly (92) (FIGS. 2-5)

In the first preferred embodiment of deflection assembly (92), the deflection mechanism (384) is comprised of a double ring eccentric mechanism. Although these eccentric rings may be located a spaced distance apart along the length of the drilling shaft (24), preferably, the deflection mechanism (384) is comprised of an eccentric outer ring (156) and an eccentric inner ring (158) provided at a single location or position along the drilling shaft (24). The rotation of the two eccentric rings (156, 158) imparts a controlled deflection of the drilling shaft (24) at the location of the deflection mechanism (384).

Particularly, the outer ring (156) has a circular outer peripheral surface (160) and defines therein a circular inner peripheral surface (162). The outer ring (156), and preferably the circular outer peripheral surface (160) of the outer ring (156), is rotatably supported by or rotatably mounted on, directly or indirectly, the circular inner peripheral surface (78) of the housing (46). The circular outer peripheral surface (160) may be supported or mounted on the circular inner peripheral surface (78) by any supporting structure, mechanism or device permitting the rotation of the outer ring (156) relative to the housing (46), such as by a roller bearing mechanism or assembly.

The circular inner peripheral surface (162) of the outer ring (156) is formed and positioned within the outer ring (156) such that it is eccentric with respect to the housing (46). In other words, the circular inner peripheral surface (162) is deviated from the housing (46) to provide a desired degree or amount of deviation.

More particularly, the circular inner peripheral surface (78) of the housing (46) is centered on the centre of the drilling shaft (24), or the rotational axis "A" of the drilling shaft (24), when the drilling shaft (24) is in an undeflected condition or the deflection assembly (92) is inoperative. The circular inner peripheral surface (162) of the outer ring (156) is centered on point "B" which is deviated from the rotational axis of the drilling shaft (24) by a distance "e".

Similarly, the inner ring (158) has a circular outer peripheral surface (166) and defines therein a circular inner peripheral surface (168). The inner ring (158), and preferably the circular outer peripheral surface (166) of the inner ring (158), is rotatably supported by or rotatably mounted on, either directly or indirectly, the circular inner peripheral surface (162) of the outer ring (156). The circular outer peripheral surface (166) may be supported by or mounted on the circular inner peripheral surface (162) by any supporting structure, mechanism or device permitting the rotation of the inner ring (158) relative to the outer ring (156), such as by a roller bearing mechanism or assembly.

The circular inner peripheral surface (168) of the inner ring (158) is formed and positioned within the inner ring (158) such that it is eccentric with respect to the circular inner peripheral surface (162) of the outer ring (156). In other words, the circular inner peripheral surface (168) of the inner ring (158) is deviated from the circular inner peripheral surface (162) of the outer ring (156) to provide a desired degree or amount of deviation.

More particularly, the circular inner peripheral surface (168) of the inner ring (158) is centered on point "C", which is deviated from the centre "B" of the circular inner peripheral surface (162) of the outer ring (156) by the same distance "e". As described, preferably, the degree of deviation of the circular inner peripheral surface (162) of the outer ring (156) from the housing (46), defined by distance "e", is substantially equal to the degree of deviation of the circular inner peripheral surface (168) of the inner ring (158) from the circular inner peripheral surface (162) of the outer ring (156), also defined by distance "e".

The drilling shaft (24) extends through the circular inner peripheral surface (168) of the inner ring (158) and is rotatably supported thereby. The drilling shaft (24) may be supported by the circular inner peripheral surface (168) by any supporting structure, mechanism or device permitting the rotation of the drilling shaft (24) relative to the inner ring (158), such as by a roller bearing mechanism or assembly.

As a result of the above described configuration, the drilling shaft (24) may be moved, and specifically may be laterally or radially deviated within the housing (46), upon the movement of the centre of the circular inner peripheral surface (168) of the inner ring (158). Specifically, upon the rotation of the inner and outer rings (158, 156), either independently or together, the centre of the drilling shaft (24) may be moved with the centre of the circular inner peripheral surface (168) of the inner ring (158) and positioned at any point within a circle having a radius summed up by the amounts of deviation of the circular inner peripheral surface (168) of the inner ring (158) and the circular inner peripheral surface (162) of the outer ring (156).

In other words, by rotating the inner and outer rings (158, 156) relative to each other, the centre of the circular inner peripheral surface (168) of the inner ring (158) can be moved in any position within a circle having the predetermined or predefined radius as described above. Thus, the portion or section of the drilling shaft (24) extending through and supported by the circular inner peripheral surface (168) of the inner ring (158) can be deflected by an amount in any direction perpendicular to the rotational axis of the drilling shaft (24).

As a result, it is possible with the double eccentric ring configuration (156,158) to control both the tool face orientation and the amount of deflection of the drilling bit (22) connected with the drilling shaft (24).

More particularly, since the circular inner peripheral surface (162) of the outer ring (156) has the centre B, which is deviated from the rotational centre A of the drilling shaft (24) by the distance "e", the locus of the centre B is represented by a circle having a radius "e" around the centre A. Further, since the circular inner peripheral surface (168) of the inner ring (158) has the centre C, which is deviated from the centre B by a distance "e", the locus of the centre "C" is represented by a circle having a radius "e" around the centre B. As a result, the centre C may be moved in any desired position within a circle having a radius of "2e" around the centre A. Accordingly, the portion of the drilling shaft (24) supported by the circular inner peripheral surface (168) of the inner ring (158) can be deflected in any direction on a plane perpendicular to the rotational axis of the drilling shaft (24) by a distance of up to "2e" (i.e., "e" plus "e"), thus providing for unlimited variation in a "Deflection ON" setting.

In addition, as stated, the deviation distances "e" are preferably substantially similar in order to permit the operation of the device (20) such that the drilling shaft (24) is undeflected within the housing (24) when directional drilling is not required. More particularly, since the degree of deviation of each of the centres B and C of the circular inner peripheral surface (162) of the outer ring (156) and the circular inner peripheral surface (168) of the inner ring (158) respectively is preferably defined by the same or equal distance "e", the centre C of the portion of the drilling shaft (24) extending through the deflection assembly (92) can be positioned on the rotational axis A of the drilling shaft (24) (i.e., "e" minus "e"), in which case the device (20) is in a zero deflection mode or is set at a "Deflection OFF" setting.

Providing for unlimited variation in the deflection of the drilling shaft (24) as described above results in the deflection assembly (92) also providing the function of the indexing assembly (93). Although such a dual function deflection assembly (92) may be desirable, it may also be relatively complex to construct, operate and maintain.

As a result, in the first preferred embodiment of deflection assembly (92), the deflection assembly (92) is configured to operate only in a "Deflection OFF" setting and a "Deflection ON" setting. The Deflection OFF setting is provided by orienting the eccentric rings (156,158) so that the eccentricities of the inner surfaces of the rings (162,168) cancel each other (i.e., "e" minus "e"). The Deflection ON setting is provided by orienting the eccentric rings (156,158) so that the eccentricities of the inner surfaces of the rings (162,168) add to each other (i.e., "e" plus "e").

This simplified configuration simplifies the actuation of the deflection assembly (92), but requires a separate indexing step to be performed in order to orient the bend in the drilling shaft (24) to achieve a desired toolface orientation.

The deflection mechanism comprising the inner and outer rings (158, 156) may be actuated by any suitable combination of longitudinally movable deflection actuator (386) and deflection linkage mechanism (388). Preferably the inner and outer rings (158, 156) are actuated either directly or indirectly using the rotation of the drilling shaft (24).

In the first preferred embodiment of deflection assembly (92), the deflection actuator (384) is comprised of a longitudinally movable sleeve cam (390).

In the first preferred embodiment of deflection assembly (92), the deflection linkage mechanism (388) is provided by a first track (392) and a second track (394) in the sleeve cam (390) which engage a rotatable first deflection linkage member (396) and a rotatable second deflection linkage member (398).

It is noted that the sleeve cam (390) is capable of longitudinal movement but not rotation, while the deflection linkage members (396,398) are capable of rotation but not longitudinal movement. In this manner, longitudinal movement of the sleeve cam (390) is converted to rotation of the deflection linkage members (396,398).

The first deflection linkage member (396) in turn is connected with one of the outer ring (156) and the inner ring (158) and the second deflection linkage member (398) is connected with the other of the outer ring (156) and the inner ring (158).

At least one of the tracks (392,394) is a spiral track. If both of the tracks (392,394) are spiral tracks, they either spiral in opposite directions or at different rates so that longitudinal movement of the sleeve cam (390) will cause the deflection linkage members (396,398) to move in the tracks (392,398) and will cause the rings (156,158) to rotate either in different directions or at different rates.

Figure 5:
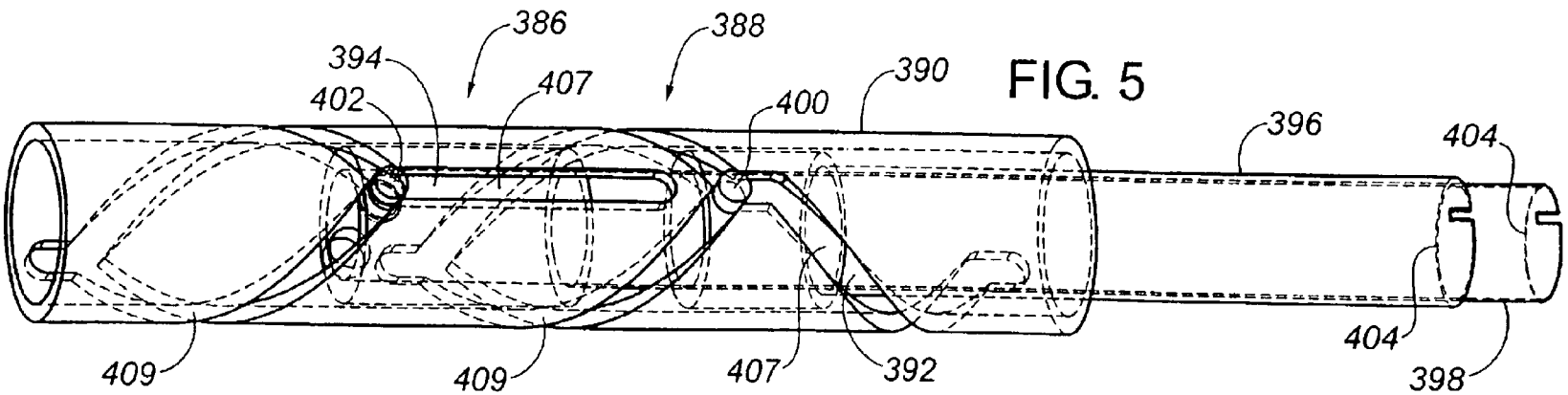
FIG. 5 is a pictorial view of the deflection actuator of FIG. 3 and of a deflection linkage mechanism for use in the first preferred embodiment of drilling shaft deflection assembly.
Figure 6A:
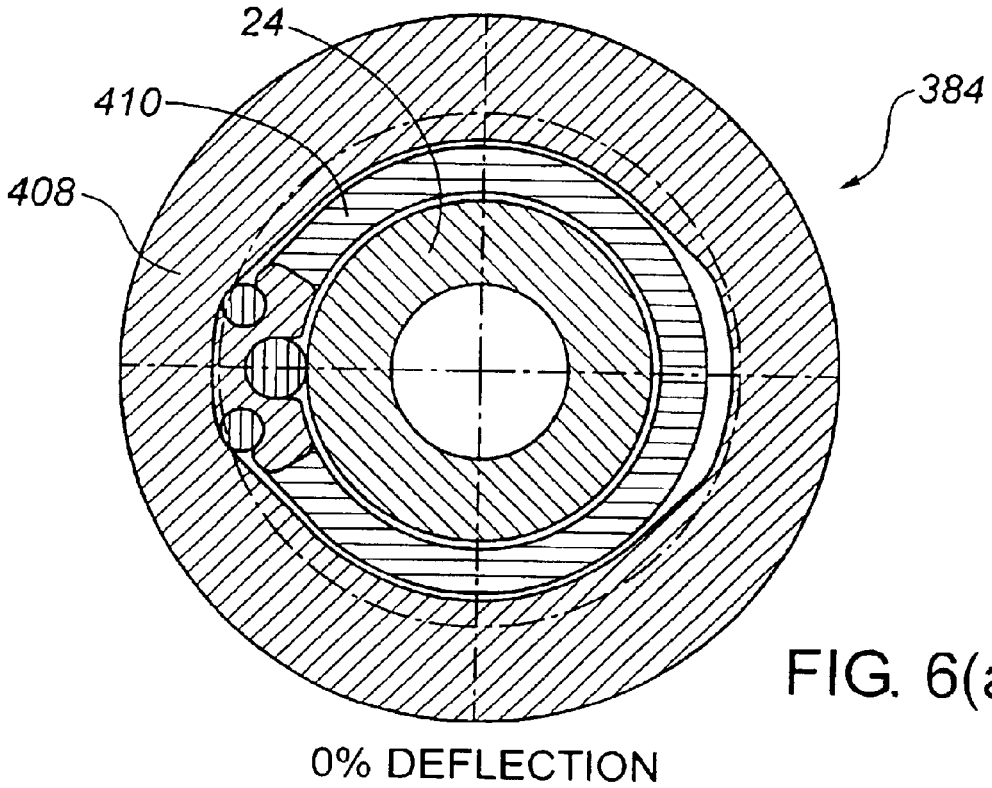
FIGS. 6(*a*) through 6(*d*) are transverse cross-section views of a deflection mechanism for a second preferred embodiment of drilling shaft deflection assembly, including a camming surface and a follower member, depicting four possible deflection positions.
Figure 6B:
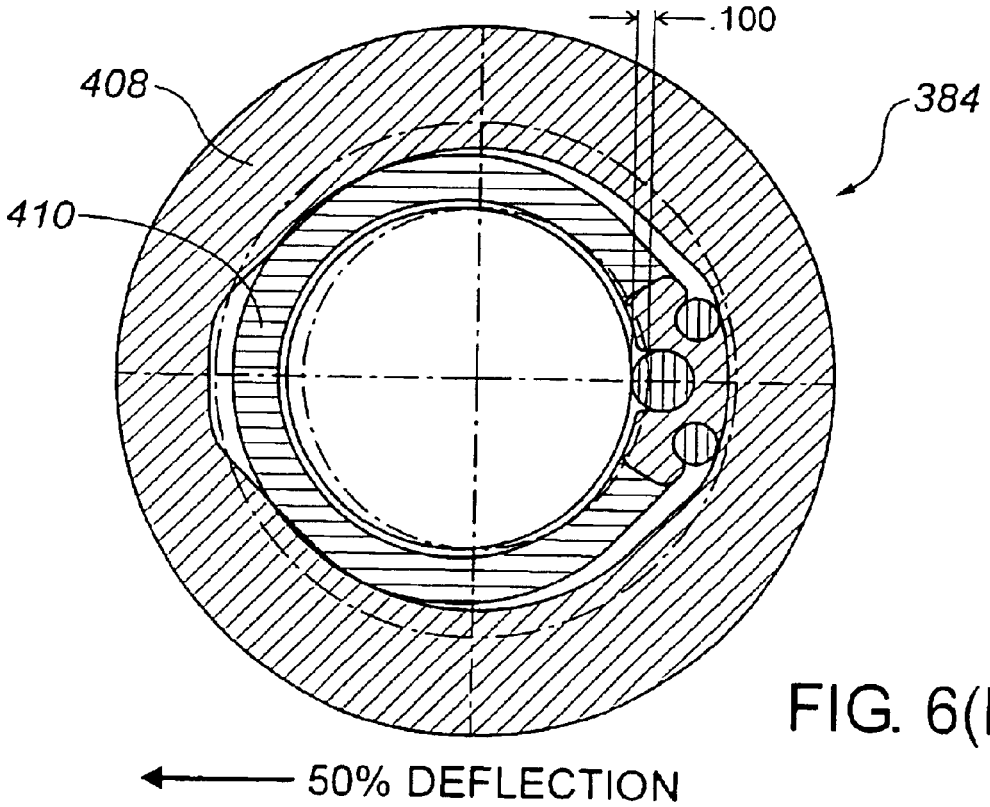
Figure 6C:
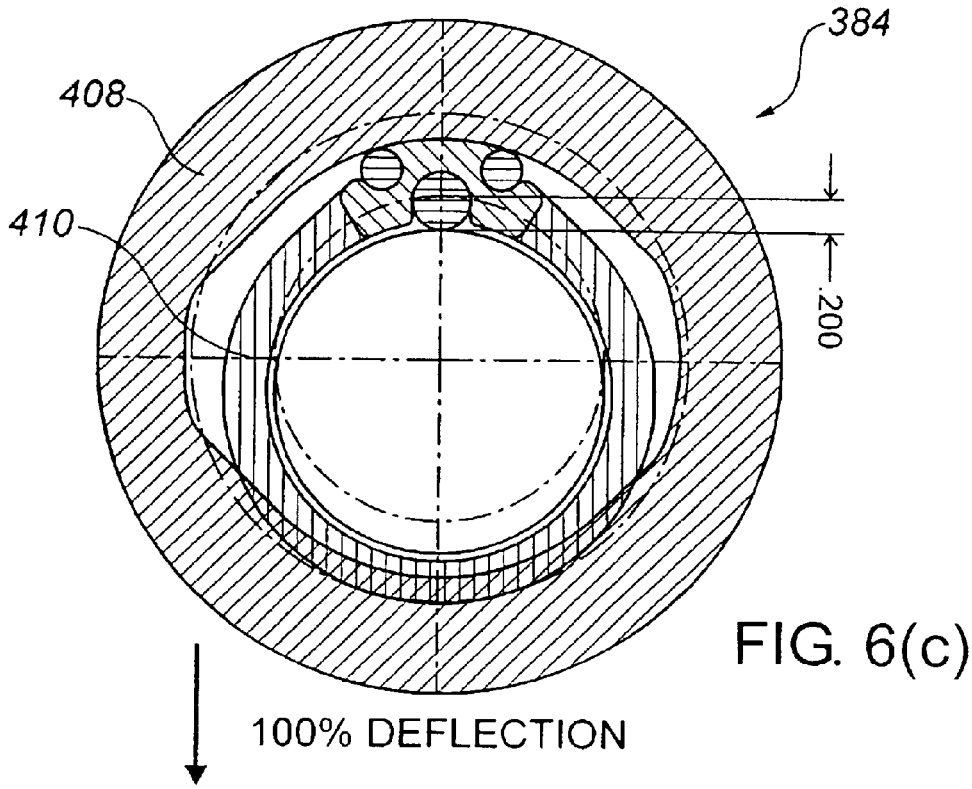
Figure 6D:
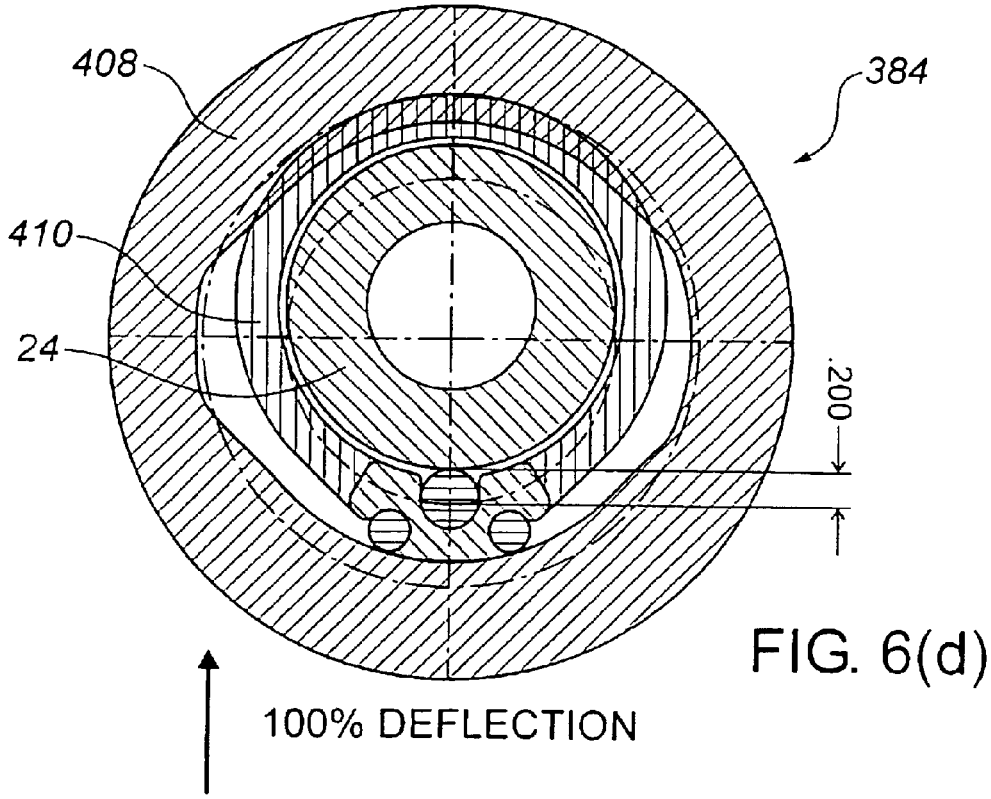

Referring to FIG. 5, the sleeve cam (390) is comprised of a hollow tube, the first deflection linkage member (396) is comprised of a hollow tube telescopically received within the sleeve cam (390), and the second deflection linkage member (398) is a hollow tube telescopically received within the first deflection linkage member (396).

Referring to FIG. 5, the first track (392) is comprised of a continuous channel in the sleeve cam which engages a first pin (400) on the first deflection linkage member (396). Similarly, the second track (394) is comprised of a continuous channel in the sleeve cam (390) which engages a second pin (402) on the second deflection linkage member (398). Preferably a gate mechanism (not shown) is provided for each of the track/pin assemblies to restrict movement of the pins in the tracks to one direction.

Figure 3:
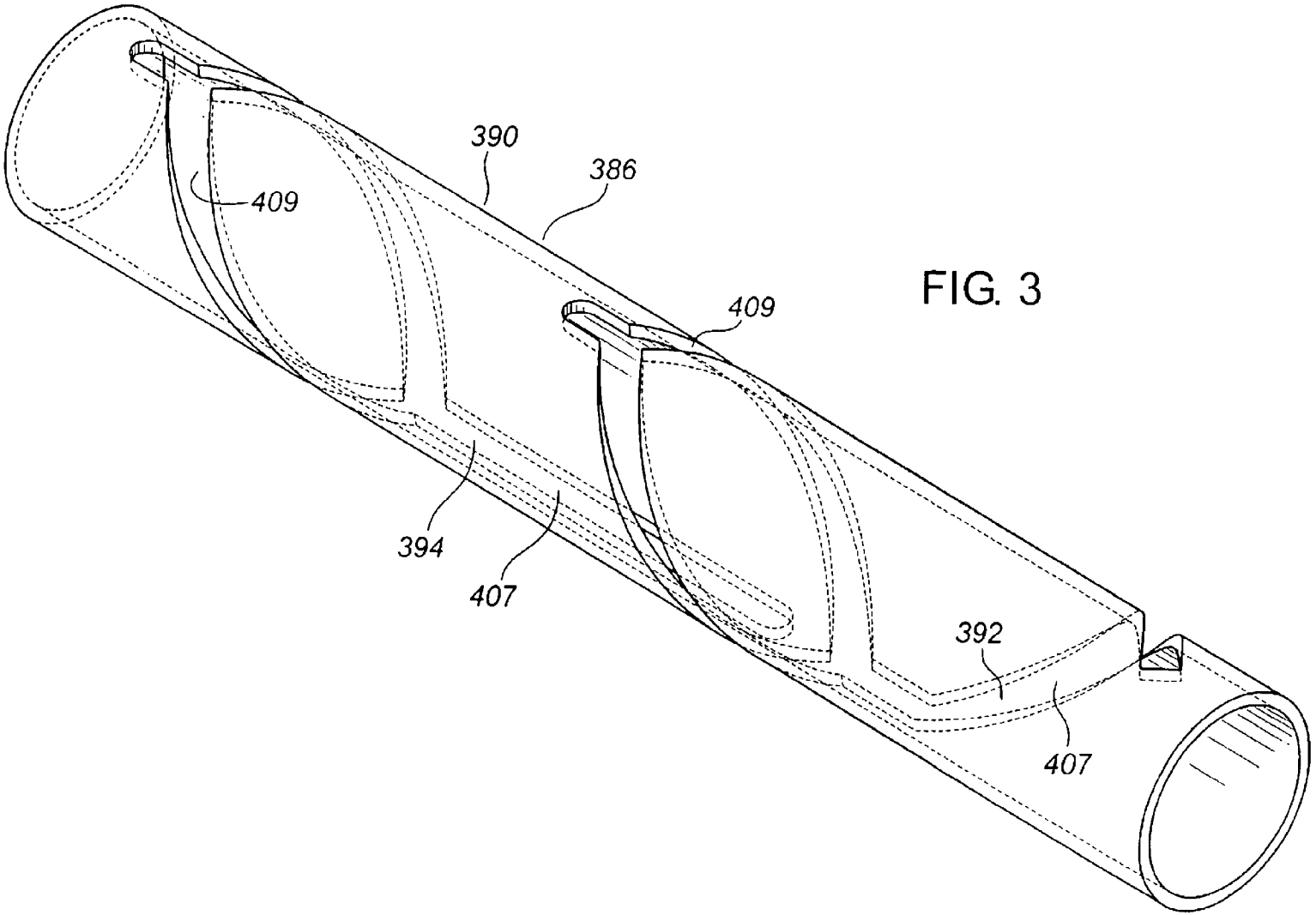
FIG. 3 is a pictorial view of a first embodiment of a deflection actuator for use in the first preferred embodiment of drilling shaft deflection assembly.

Referring to FIG. 3, the first track (392) is a spiral track and the second track (394) is a straight track, so that the first deflection linkage member (396) will impart rotation to one of the rings (156,158) upon longitudinal movement of the sleeve cam (390) while the second deflection linkage member (398) will impart no rotation to the other of the rings (156,158) upon longitudinal movement of the sleeve cam (390).

Figure 4:
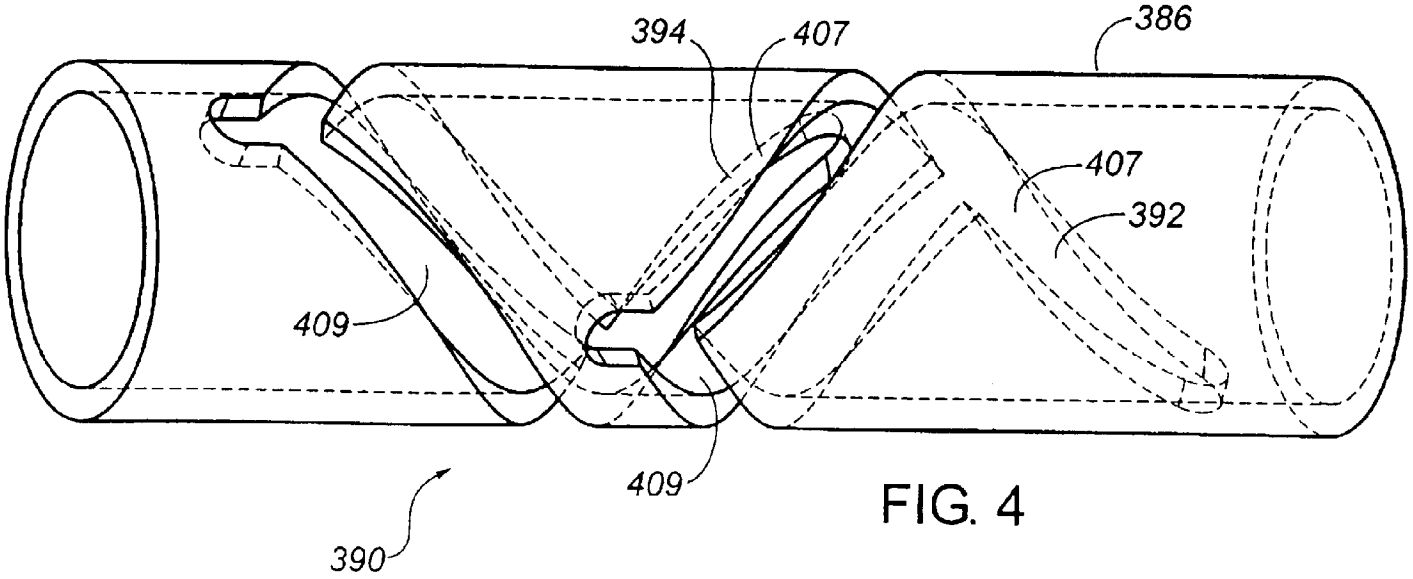
FIG. 4 is a pictorial view of a second embodiment of a deflection actuator for use in the first preferred embodiment of drilling shaft deflection assembly.

Referring to FIG. 4, the first track (392) is a spiral track and the second track (394) is also a spiral track in the opposite direction, so that the first deflection linkage member (396) will impart rotation to one of the rings (156,158) in one direction upon longitudinal movement of the sleeve cam (390) while the second deflection linkage member (398) will impart rotation to the other of the rings (156,158) in the opposite direction upon longitudinal movement of the sleeve cam (390). The embodiment of sleeve cam (390) depicted in FIG. 4 facilitates a shorter sleeve cam (390) than the embodiment of sleeve cam (390) depicted in FIG. 3.

The deflection linkage members (396,398) each include a drive end (404) to which the rings (156,158) may be directly or indirectly connected to provide for actuation of the deflection mechanism (384).

Figure 7A:
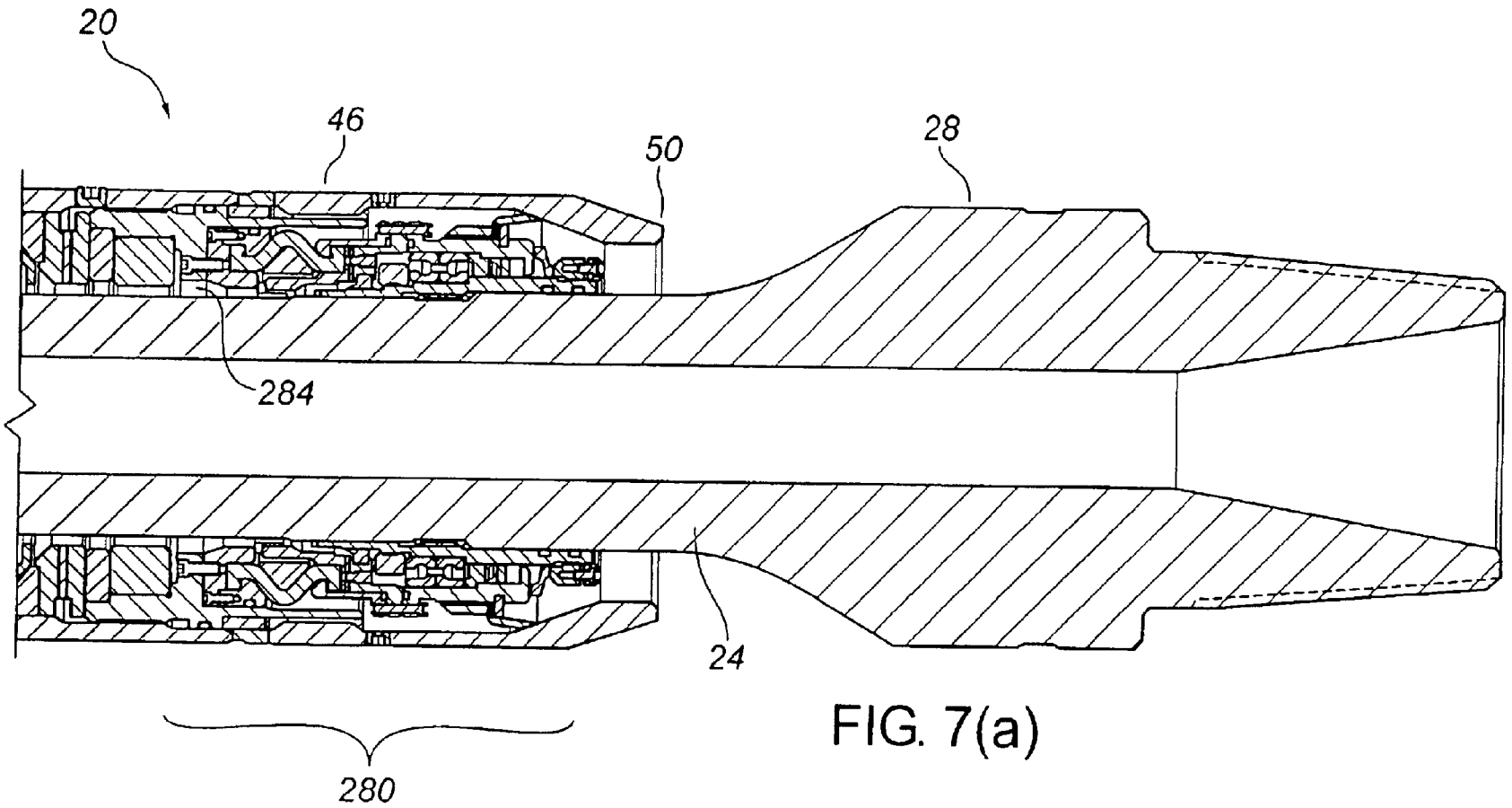
Figure 7B:
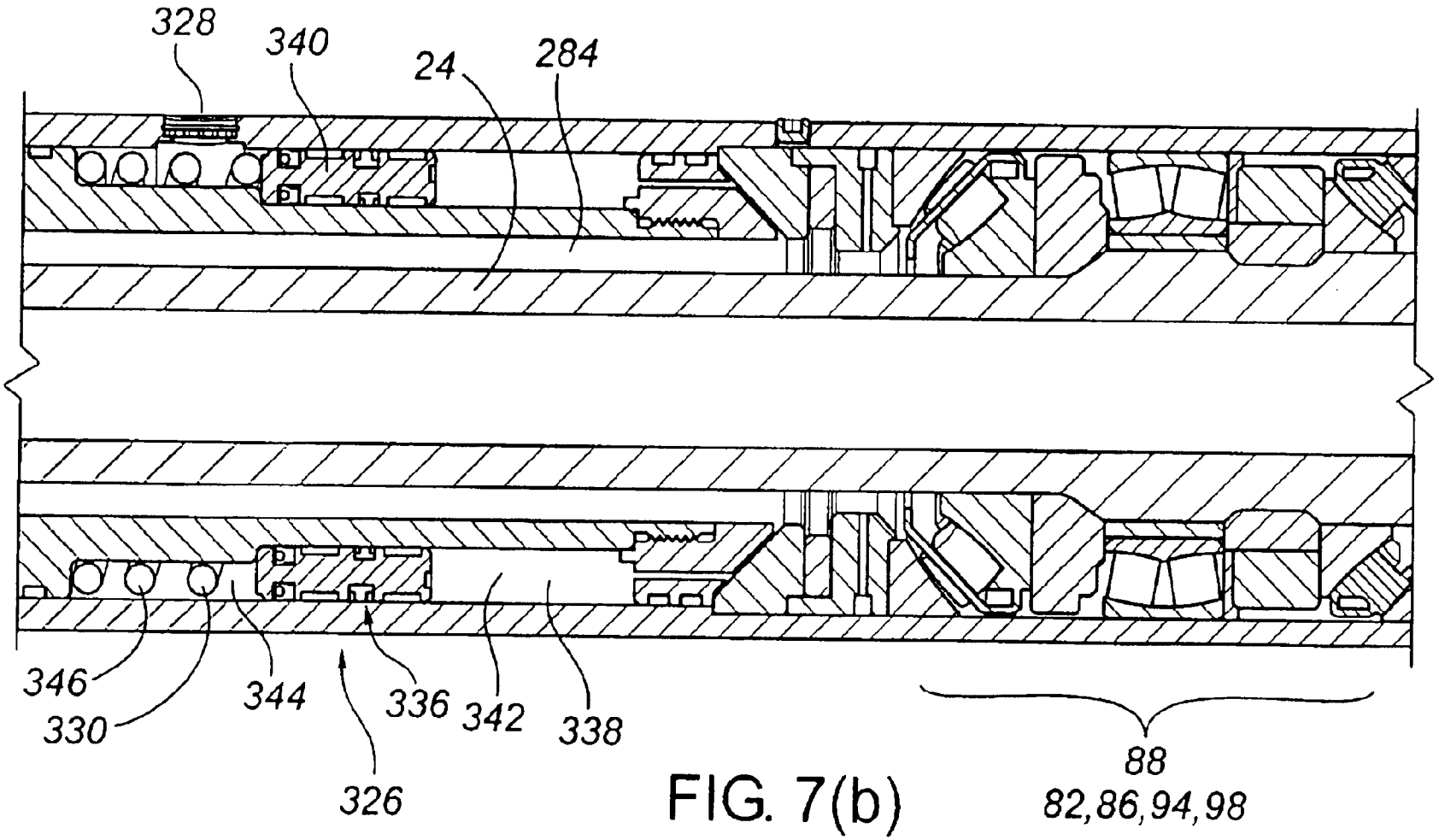
Figure 7C:
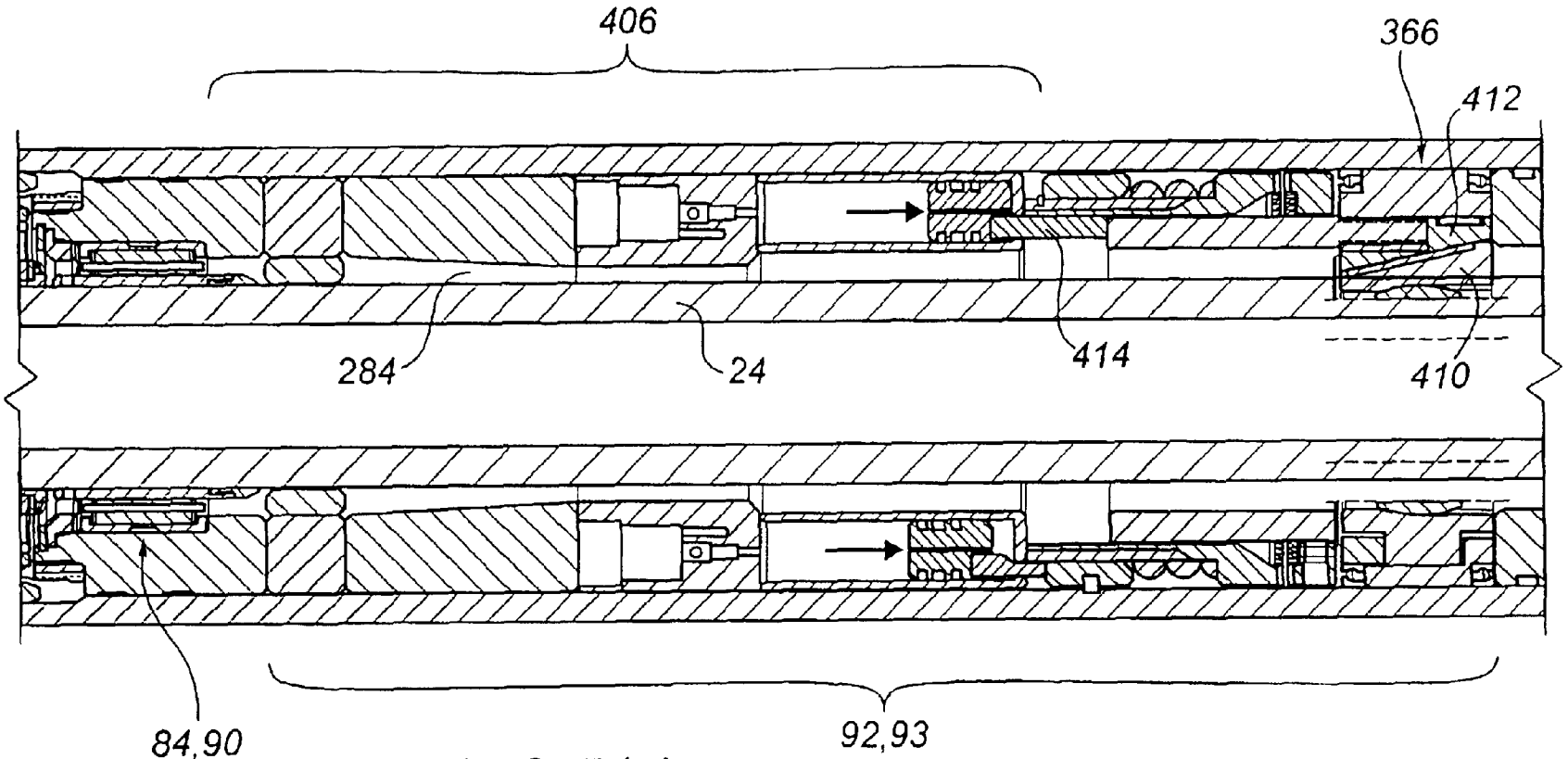
Figure 7D:
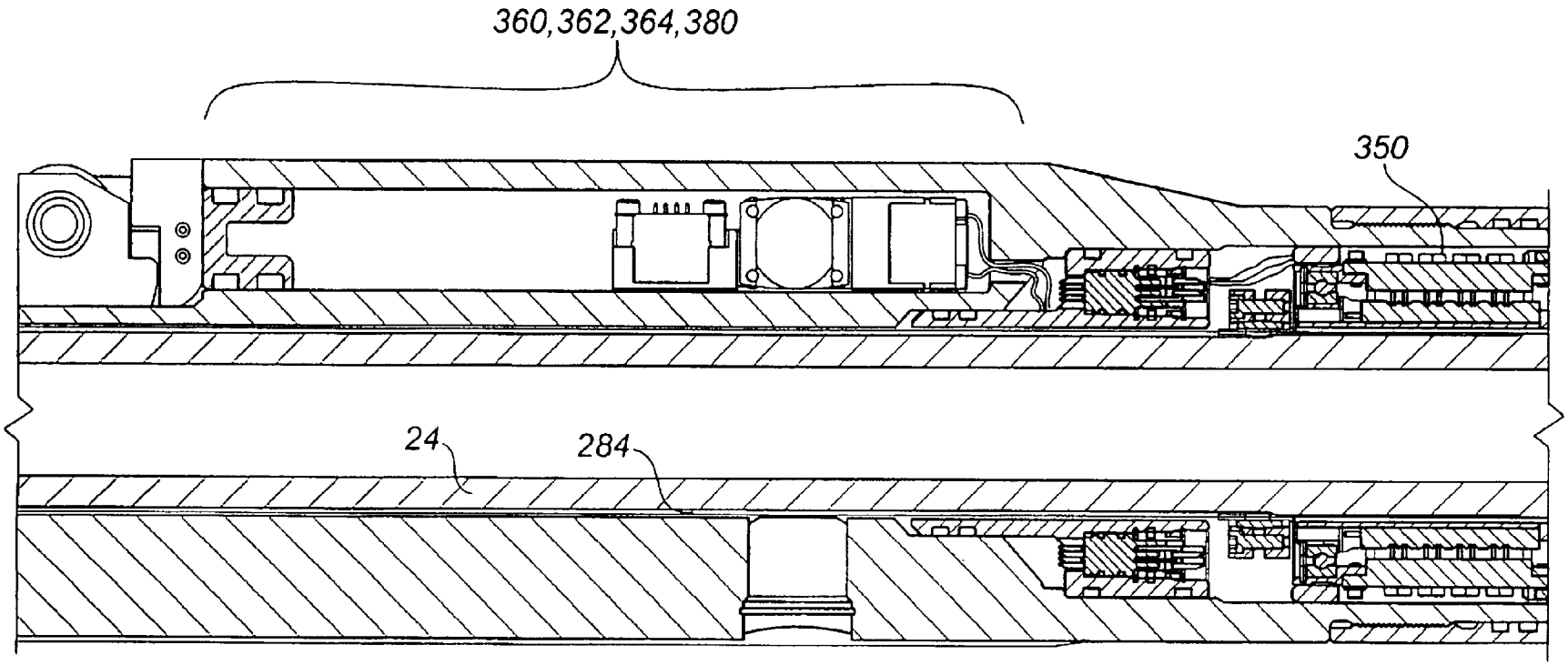
Figure 7E:
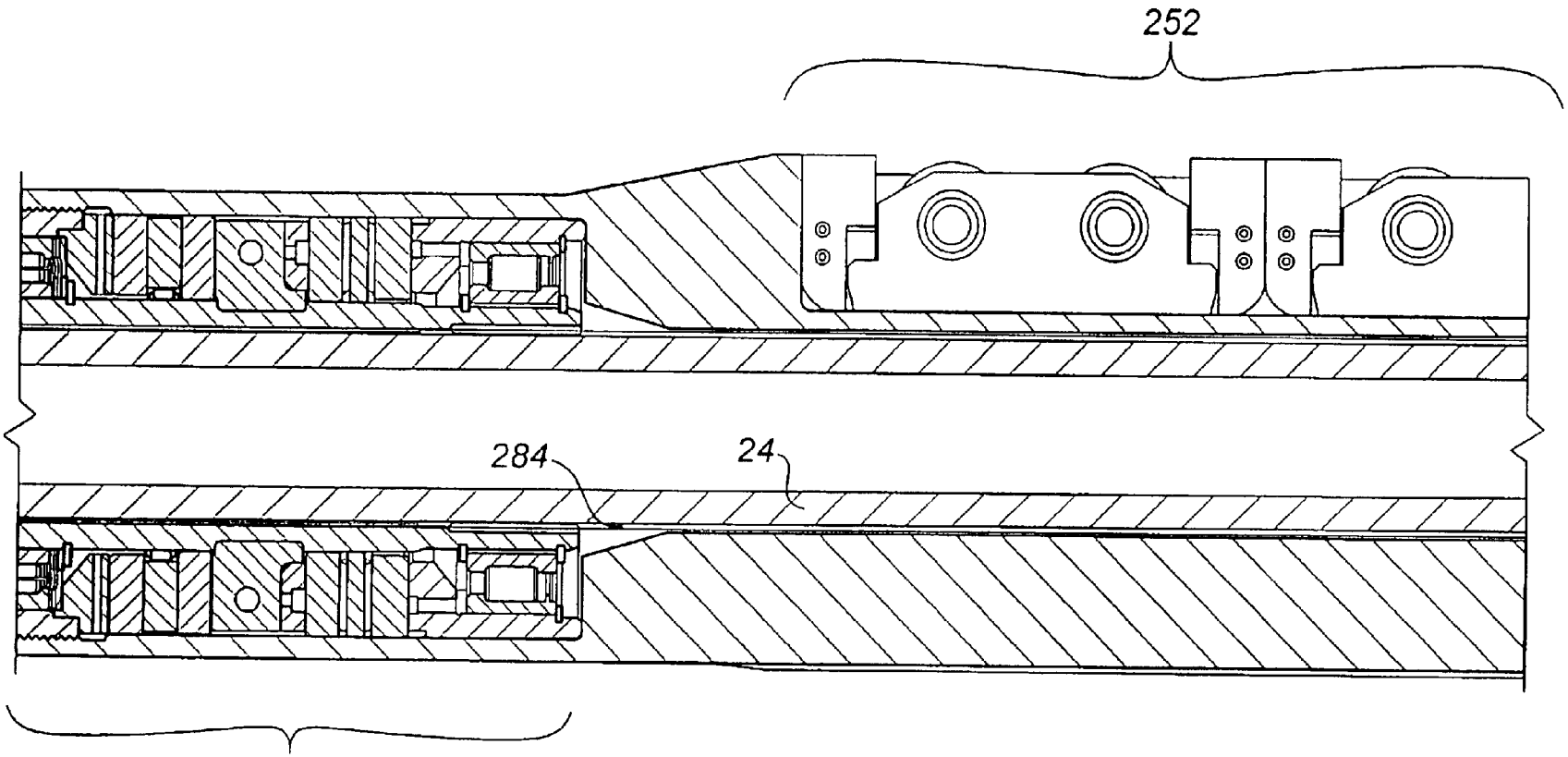
Figure 7F:
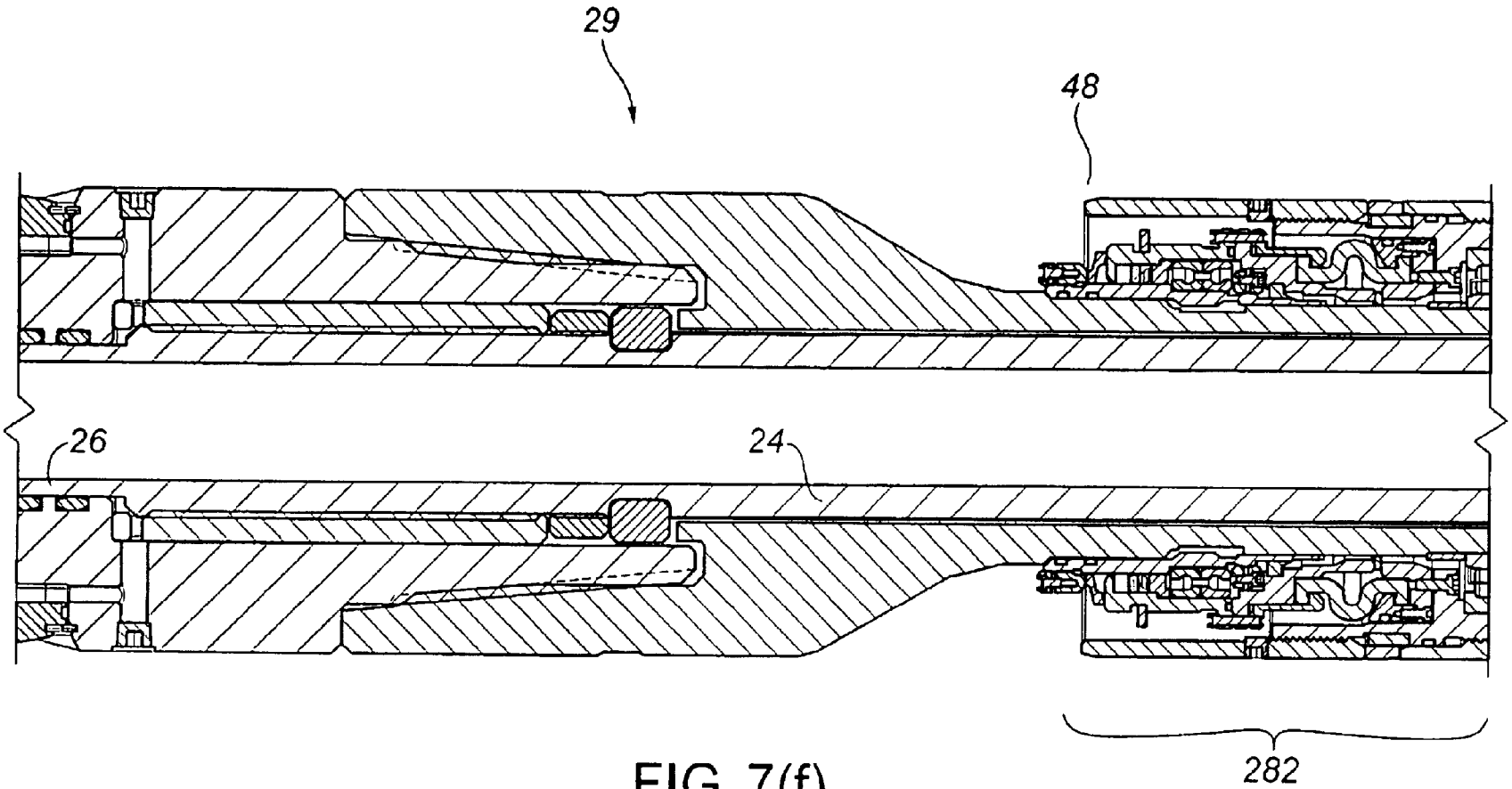
Figure 7G:
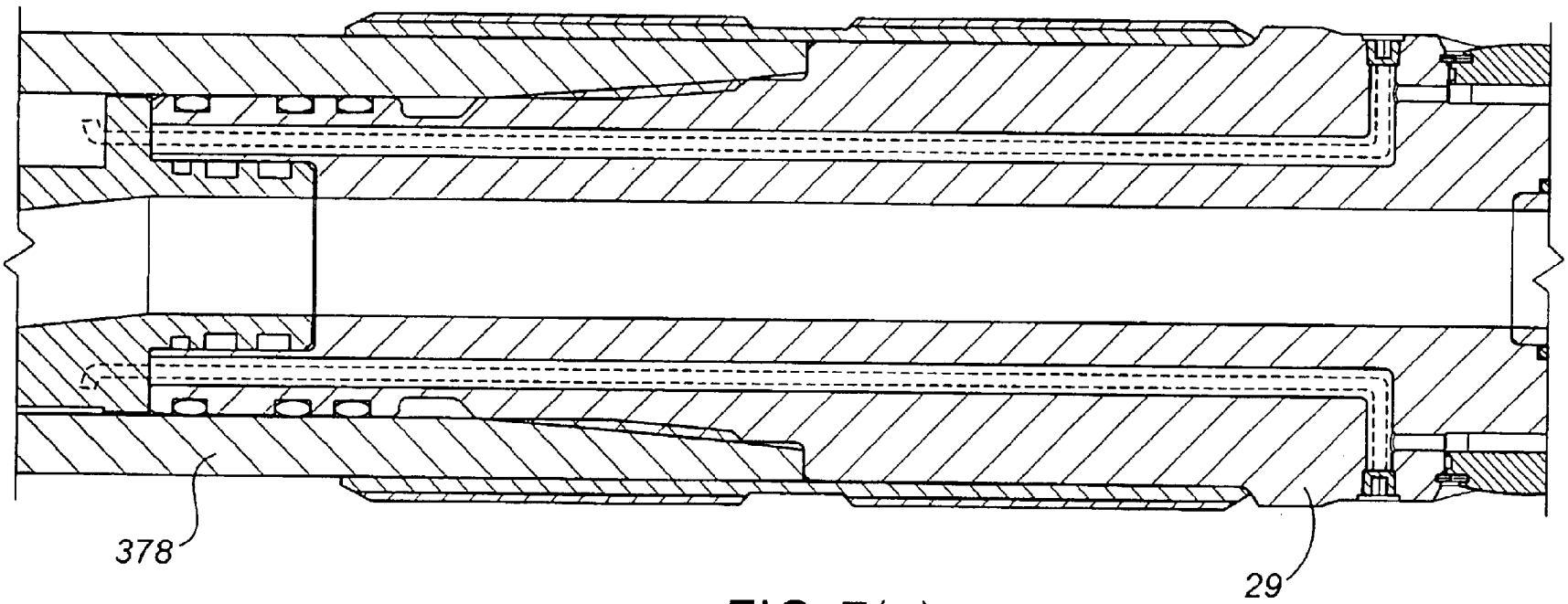
Figure 7H:
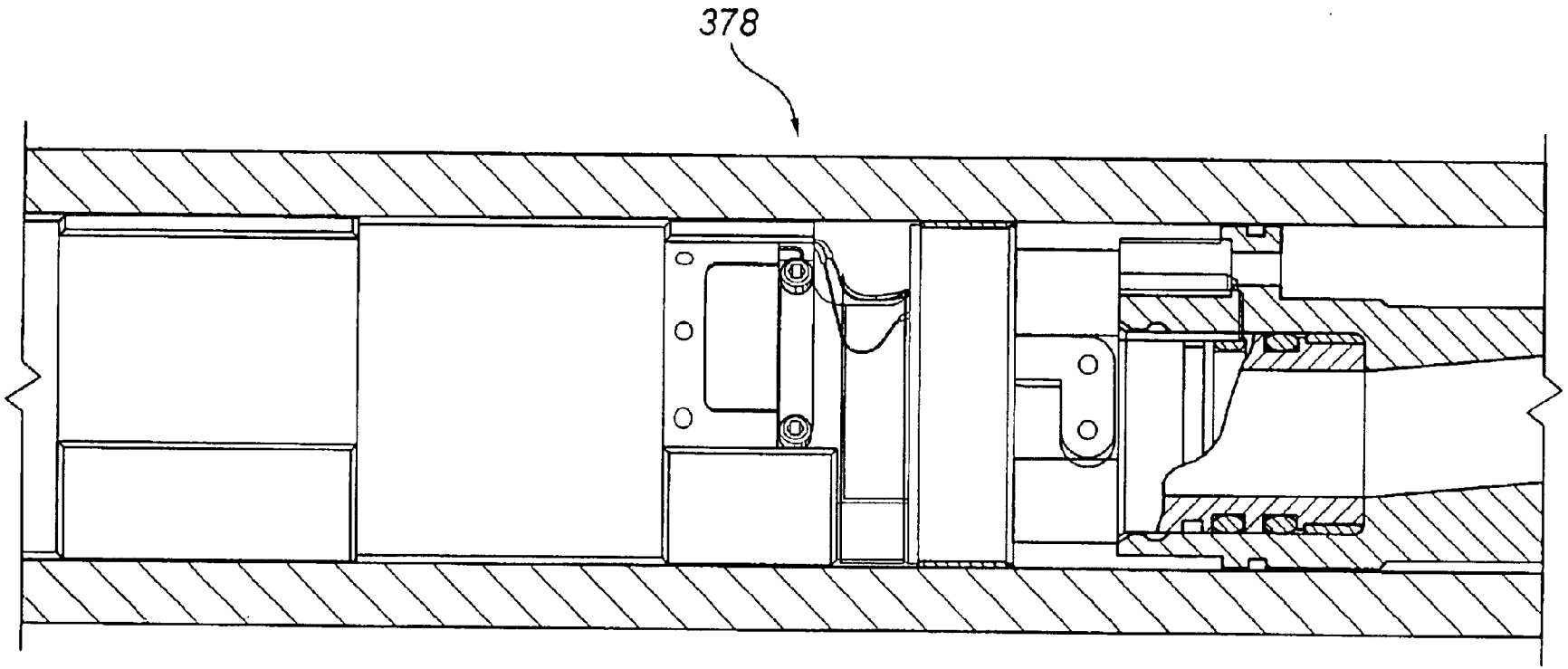
Figure 7I:
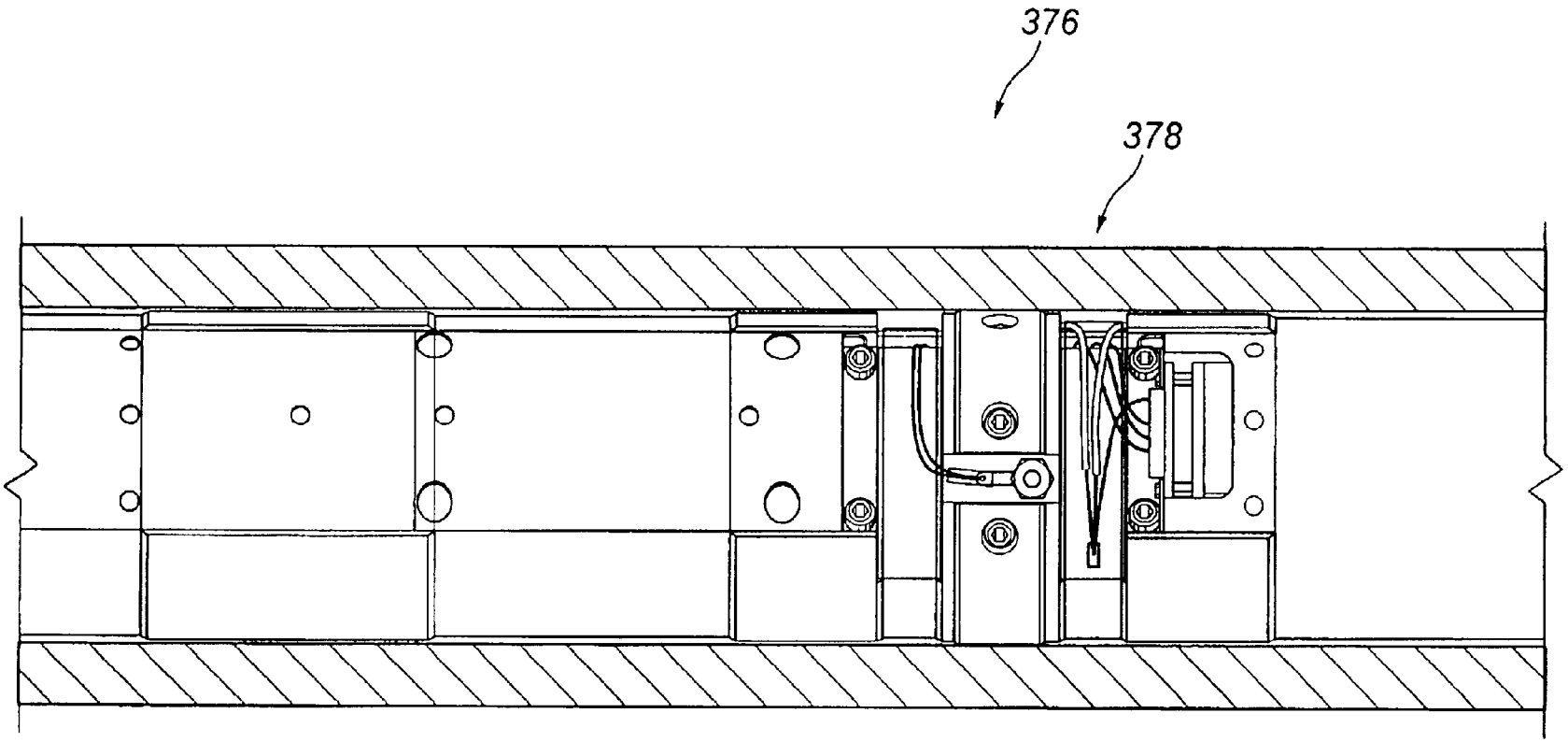
Figure 7J:
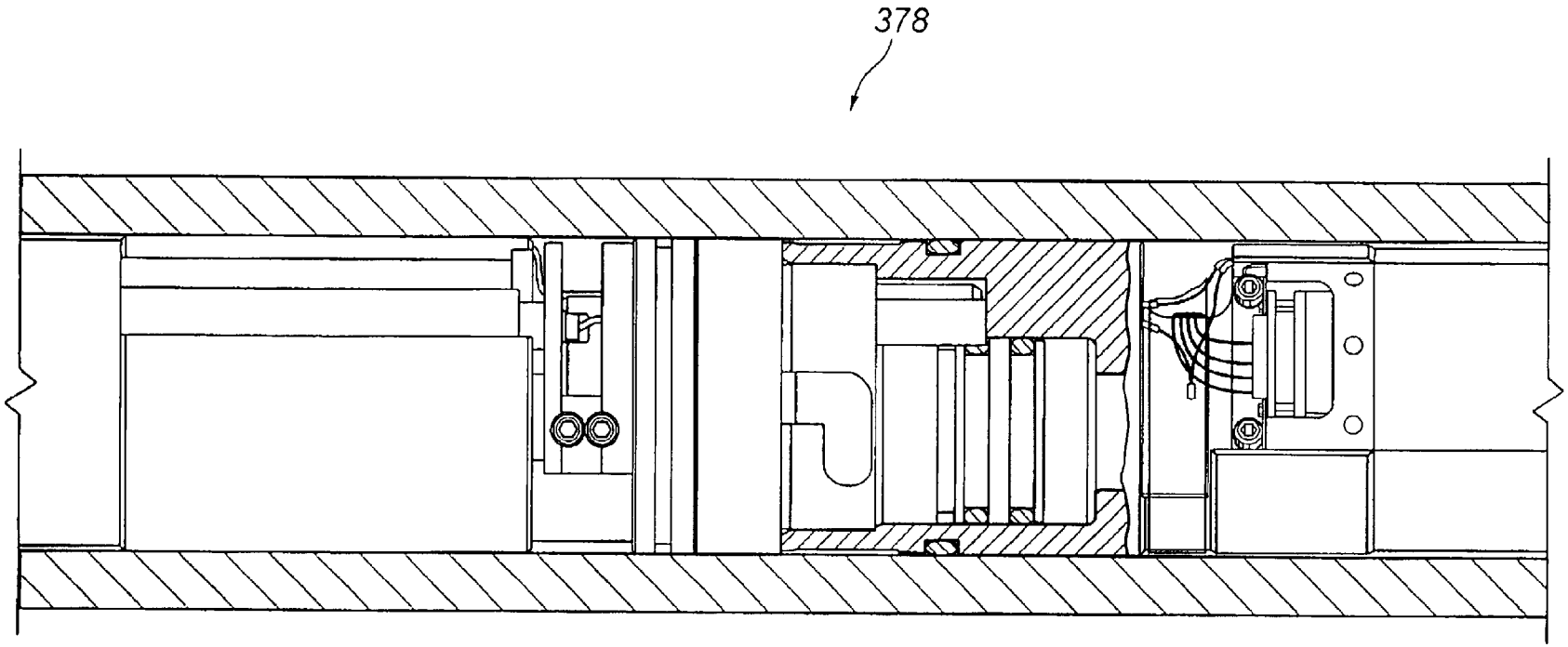
Figure 7K:
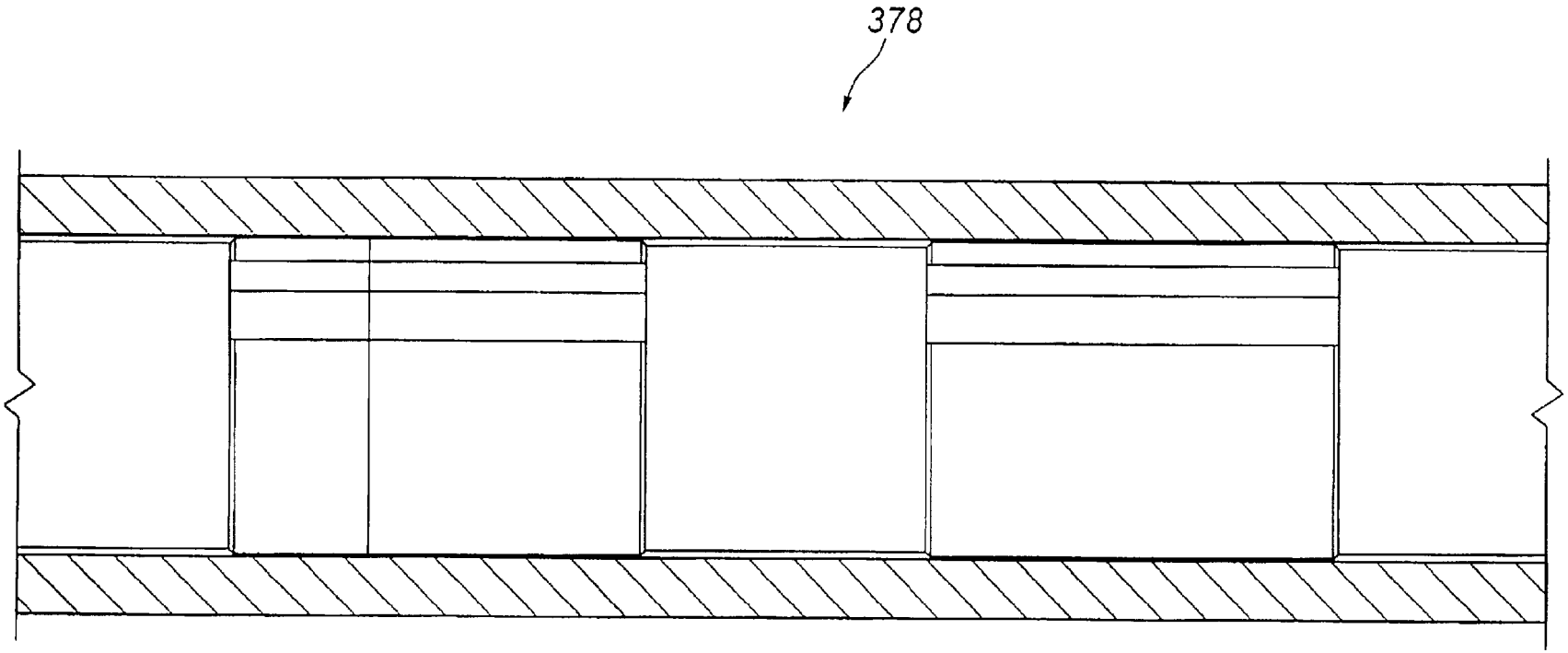
Figure 7L:
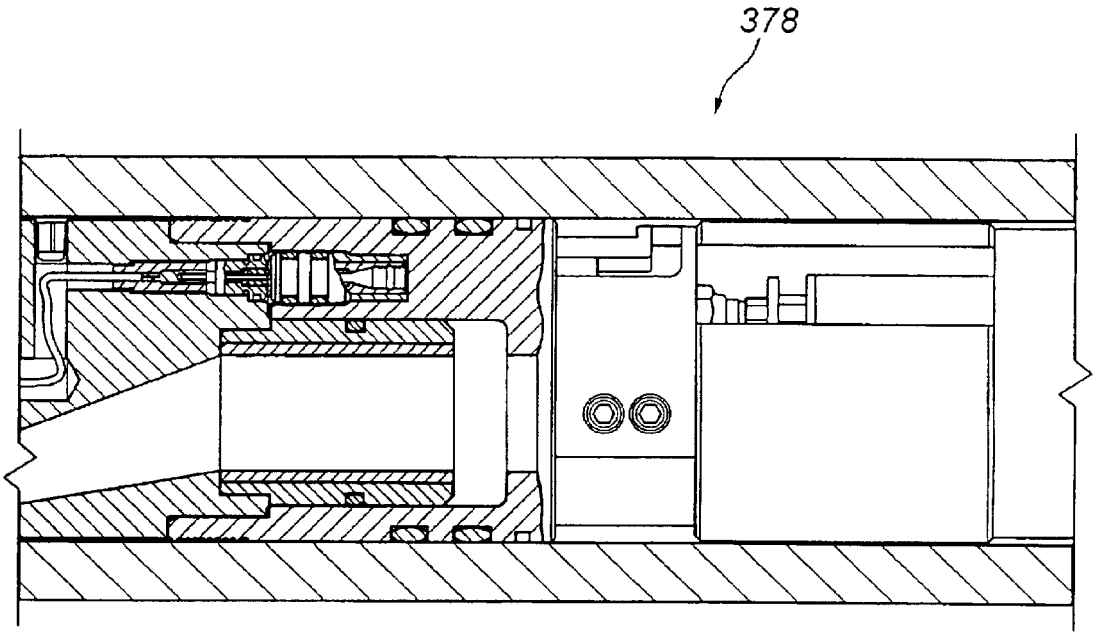
Figure 7M:
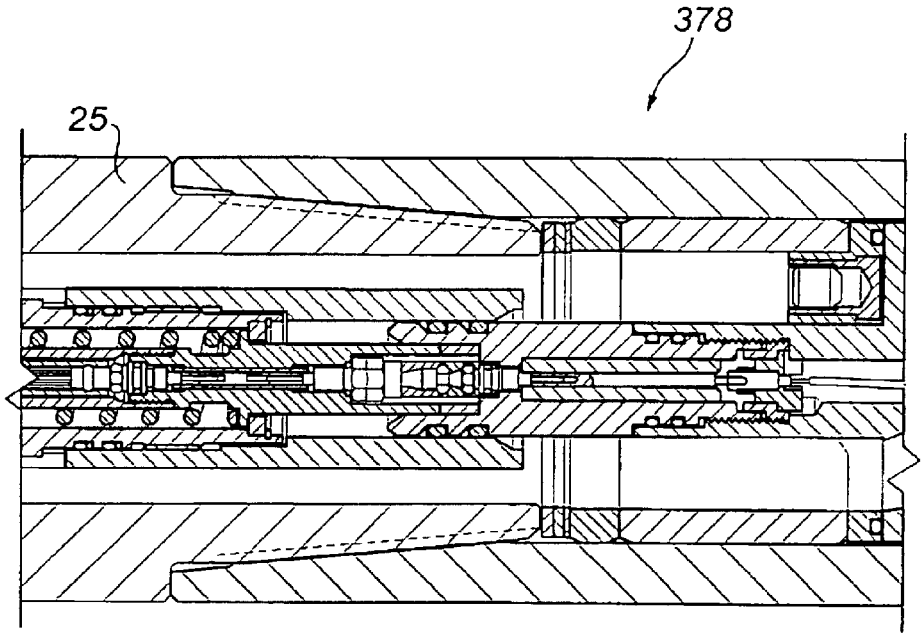

The reciprocation of the sleeve cam (390) is powered by a power source (406). Referring to FIG. 7(c), the preferred power source (406) for the deflection assembly (92) is comprised of a hydraulic pump, a cylinder, and a piston which is either directly or directly connected with the sleeve cam (390). Preferably the power source (406) is double acting so that it provides power to reciprocate the sleeve cam in opposite directions, in order to move the deflection mechanism (384) between a Deflection OFF position and a Deflection ON position.

The deflection assembly (92) as described above may thus be used to provide deflection of the drilling shaft (24). Indexing of the deflection mechanism (384) to provide a desired toolface orientation can then be-provided by a separate indexing assembly (93) such as the embodiments of indexing assembly (93) described below.

Alternatively, in the first preferred embodiment of deflection assembly (92), the indexing assembly (93) may be comprised of an "extension" of the deflection assembly (92). Specifically, and referring to FIGS. 3–5, each of the first track (392) and the second track (394) may be comprised of a deflection segment (407) and an indexing segment (409).

The deflection segments (407) of the tracks (392,394) serve to deflect and straighten the drilling shaft (24) while the indexing segments (409) of the tracks (392,394) serve to rotate both rings (156,158) at the same rate and in the same direction in order to orient the direction of the bend in the drilling shaft (24). Each cycle of actuation of the sleeve cam through the indexing segments (409) will provide a predetermined rotation of the deflection mechanism (384) which depends upon the shape and slope of the spiral of the indexing segments (409).

Finally, if the deflection assembly (92) is not intended to perform an indexing function, it is possible to omit the second deflection linkage mechanism, including the second track (394), the second pin (402), and the second deflection linkage member (398), since the drilling shaft (24) can be bent simply by rotation of one of the rings (156,158) relative to the other ring without any need for rotating the other ring. Indexing of the deflection mechanism (384) can then be performed by a separate indexing assembly (93).

(b) Second Preferred Embodiment of Deflection Assembly (92) (FIG. 6)

The second preferred embodiment of deflection assembly (92) is essentially a variation of the first embodiment of deflection assembly (92). The difference between the two embodiments relates primarily to the design of the deflection mechanism (384).

Specifically, the outer ring (156) of the first preferred embodiment is replaced with a rotary camming surface (408) and the inner ring (158) is replaced with a follower member (410). Rotation of the camming surface (408) relative to the follower member (410) will serve to deflect the drilling shaft (24). Coordinated rotation of both the camming surface (408) and the follower member (410) may serve to index the deflection mechanism (384) to provide a desired orientation for the bend in the drilling shaft (24).

Longitudinal movement of the deflection actuator (386) is therefore converted by the deflection linkage mechanism (388) and the deflection mechanism (384) into deflection of the drilling shaft (24). Similarly, longitudinal movement of the deflection actuator (386) may be used to provide an indexing function as described above with respect to the first preferred embodiment of deflection assembly (92).

(c) Third Preferred Embodiment of Deflection Assembly (92) (FIGS. 7–13)

The third embodiment of deflection assembly (92) may be implemented in many designs which fall within the scope of the invention. Two such designs are depicted in FIGS. 7-13.

In the third embodiment, the deflection mechanism (384) is comprised of at least one follower member (410), and the deflection linkage mechanism (388) is comprised of at least one longitudinally movable camming surface (412). The deflection actuator (386) is comprised of a longitudinally movable deflection actuator member (414).

The follower member (410) is capable of lateral movement between the housing (46) and the drilling shaft (24) but is not capable of longitudinal movement. The follower member (410) directly or indirectly engages the drilling shaft (24) so that lateral movement of the follower member (410) results in lateral movement of the drilling shaft (24).

The actuation of the deflection assembly (92) is powered by the power source (406). An exemplary power source is depicted in FIG. 7(*c*) and schematically in FIG. 8. Preferably the power source (406) is double acting in order to provide power to move the camming surface or surfaces (412) in opposite directions.

The camming surface (412) may be integrated with the deflection actuator member (414) or it may be a separate component which is connected with the deflection actuator member (414).

The follower member (410) and the camming surface (412) provide complementary ramp surfaces which engage each other to move the follower member (410) laterally in response to longitudinal movement of the camming surface. The lateral movement of the follower member results in deflection of the drilling shaft (24).

The follower member (410) may include a plurality of follower member surfaces (416) for engaging a plurality of camming surfaces (412). This configuration of follower member is useful either for providing support for opposing sides of the drilling shaft (24) in the case of uni-axial deflection, or for facilitating multi-axial deflection of the drilling shaft (24) with a single follower member (410). Alternatively, the same results can be achieved with a plurality of follower members (410).

Figure 8:
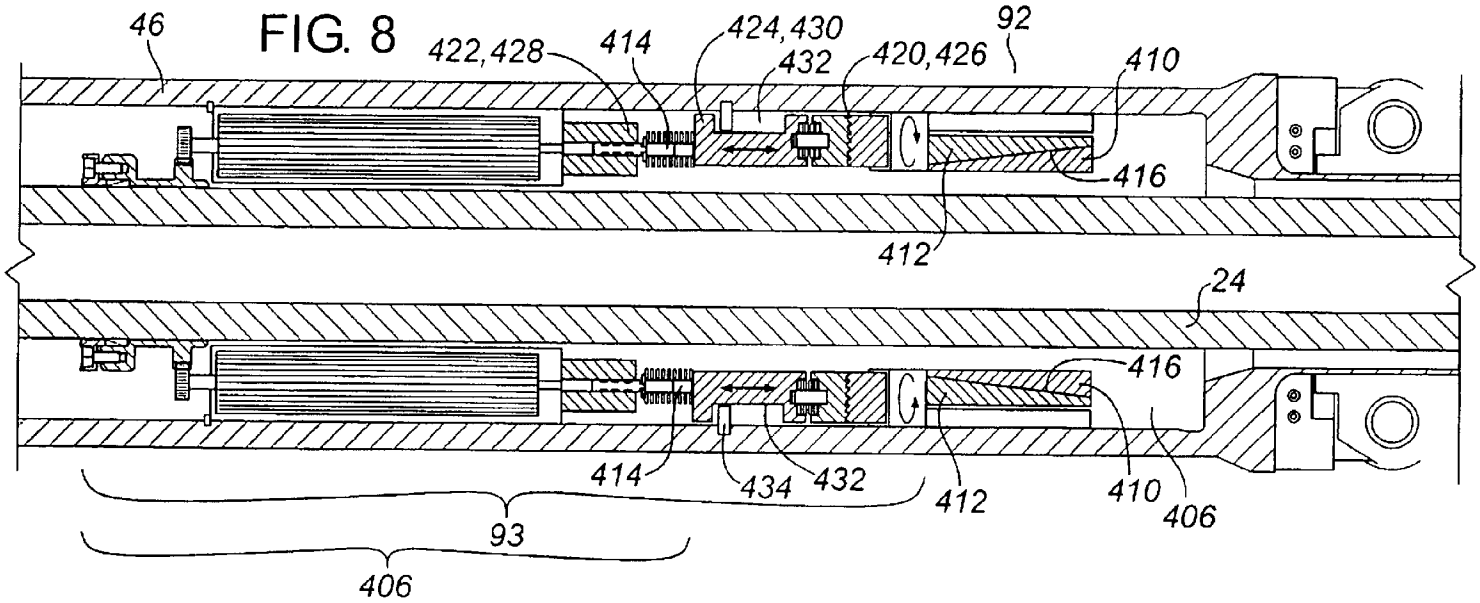
FIG. 8 is a schematic longitudinal cross-section assembly view of the drilling shaft deflection assembly depicted in FIG. 7 and of a first preferred embodiment of indexing assembly.
Figure 9B:
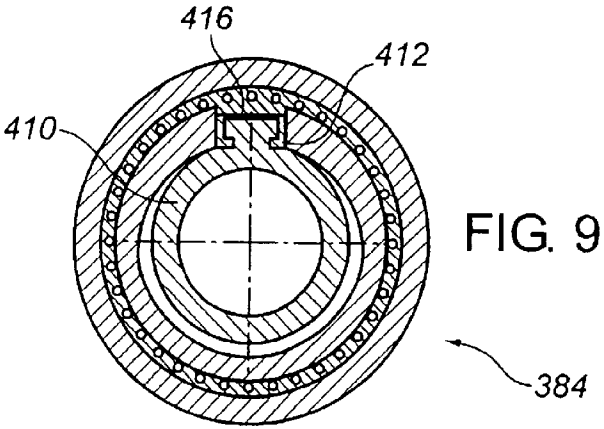
FIGS. 9(*a*) and 9(*b*) are transverse cross-section views of the deflection mechanism for the drilling shaft deflection assembly depicted in FIG. 7, depicting different deflection positions.
Figure 9A:
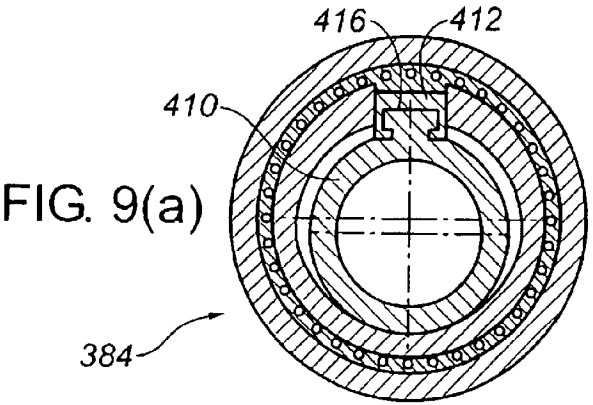
Figure 10:
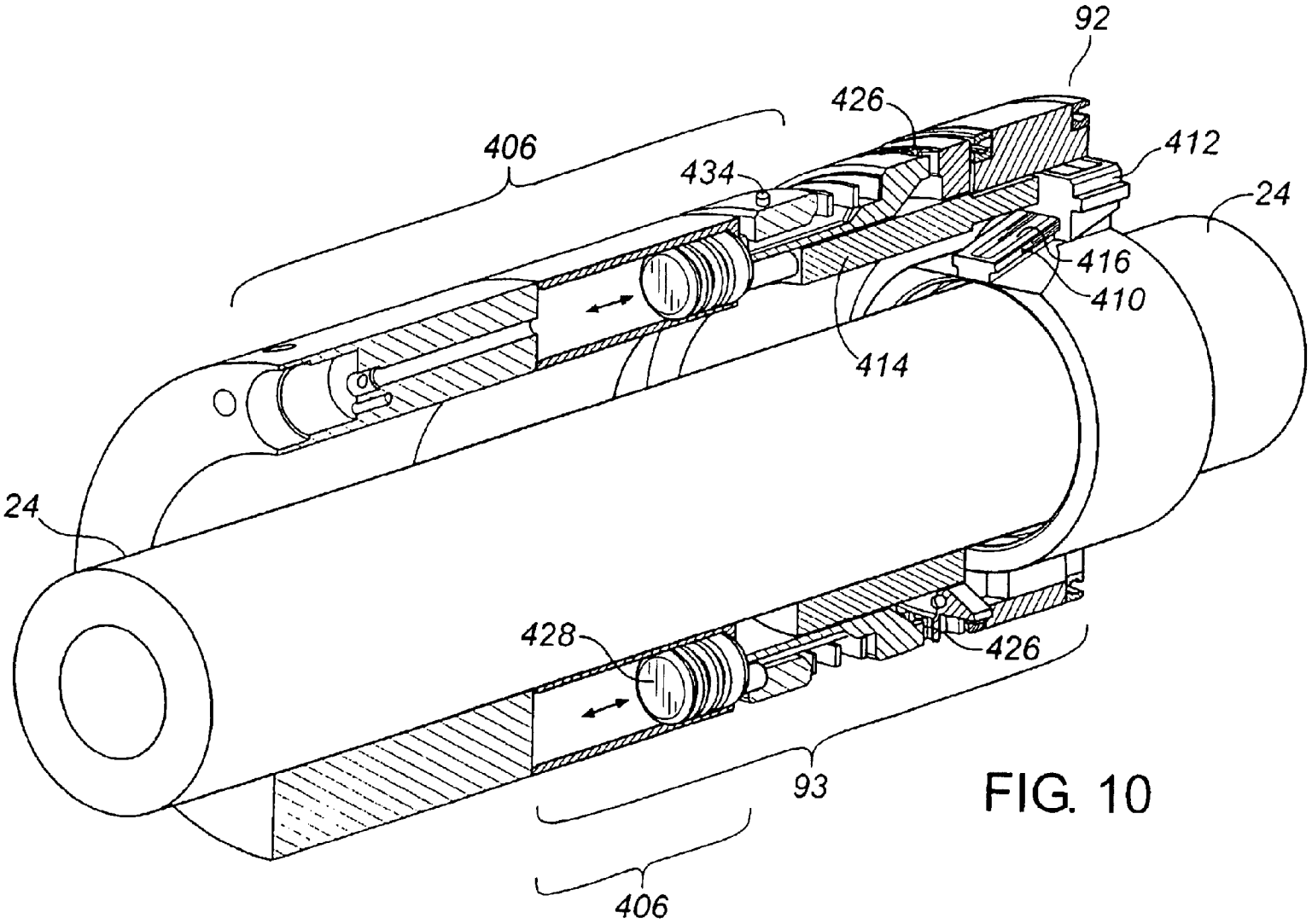
FIG. 10 is a cut-away pictorial view of the drilling shaft deflection assembly depicted in FIG. 7.

FIG. 7(*c*) and FIGS. 8–10 depict a deflection assembly (92) which provides for uni-axial deflection of the drilling shaft (24).

FIGS. 7(*c*), 9 and 10 depict a uni-axial deflection mechanism (384) which includes a single camming surface (412), a single follower member (410) and a single follower member surface (416). The disadvantage to this configuration is that the drilling shaft (24) is not supported in two positions at the location of the bend, with the result that the drilling shaft (24) may be prone to whipping or buckling at the location of the bend.

FIG. 8 depicts schematically a uni-axial deflection mechanism (384) which includes two camming surfaces (412), a single follower member (410), and two follower member surfaces (416). It is noted that the complementary ramp surfaces for the two sets of camming surface (412)/follower member surface (416) are directed in opposing directions to accommodate both bending and support of the drilling shaft (24). This configuration for uni-axial bending of the drilling shaft facilitates support for the drilling shaft (24) both above and below the bend.

Figure 11:
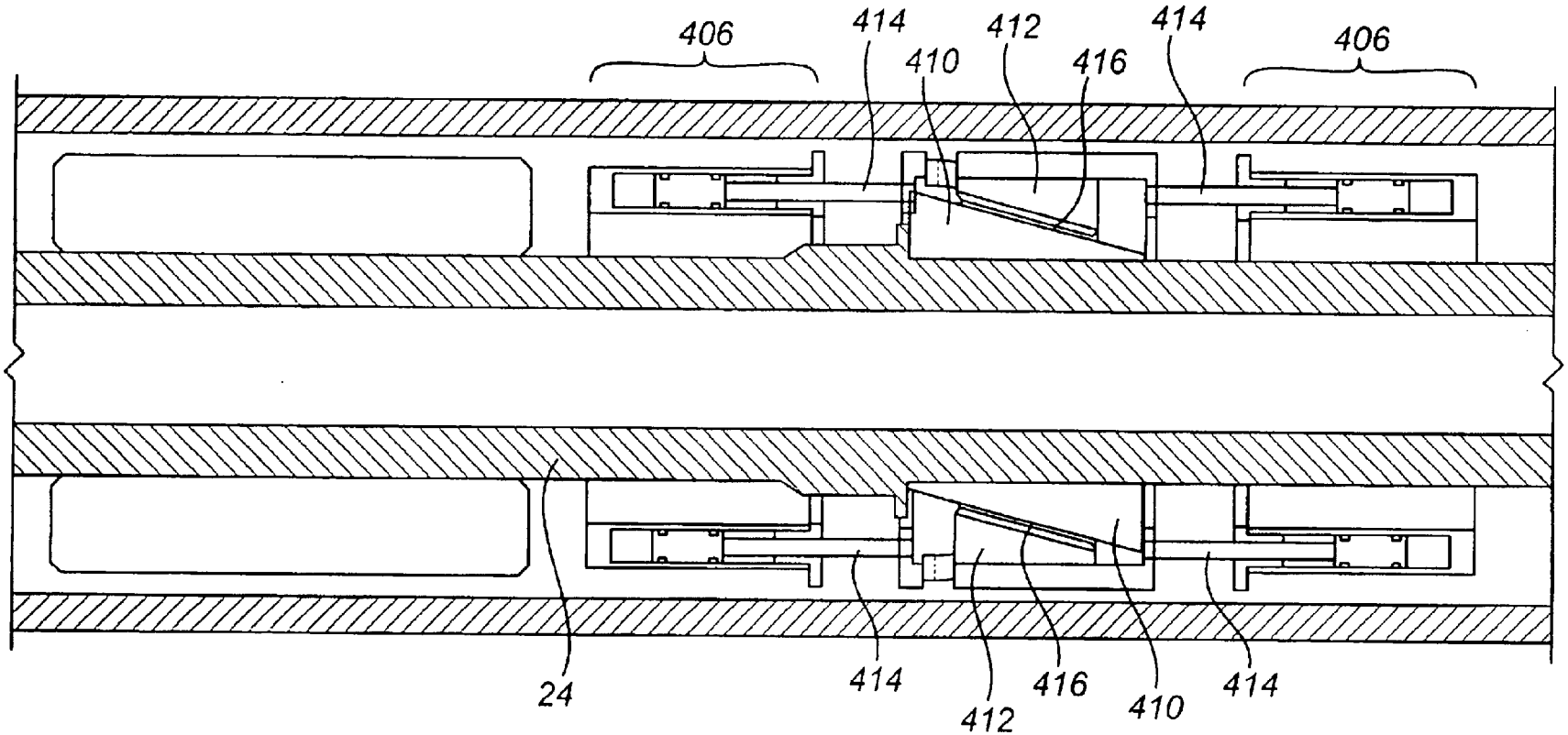
FIG. 11 is a schematic longitudinal cross-section view of a second version of the third preferred embodiment of drilling shaft deflection assembly.
Figure 12:
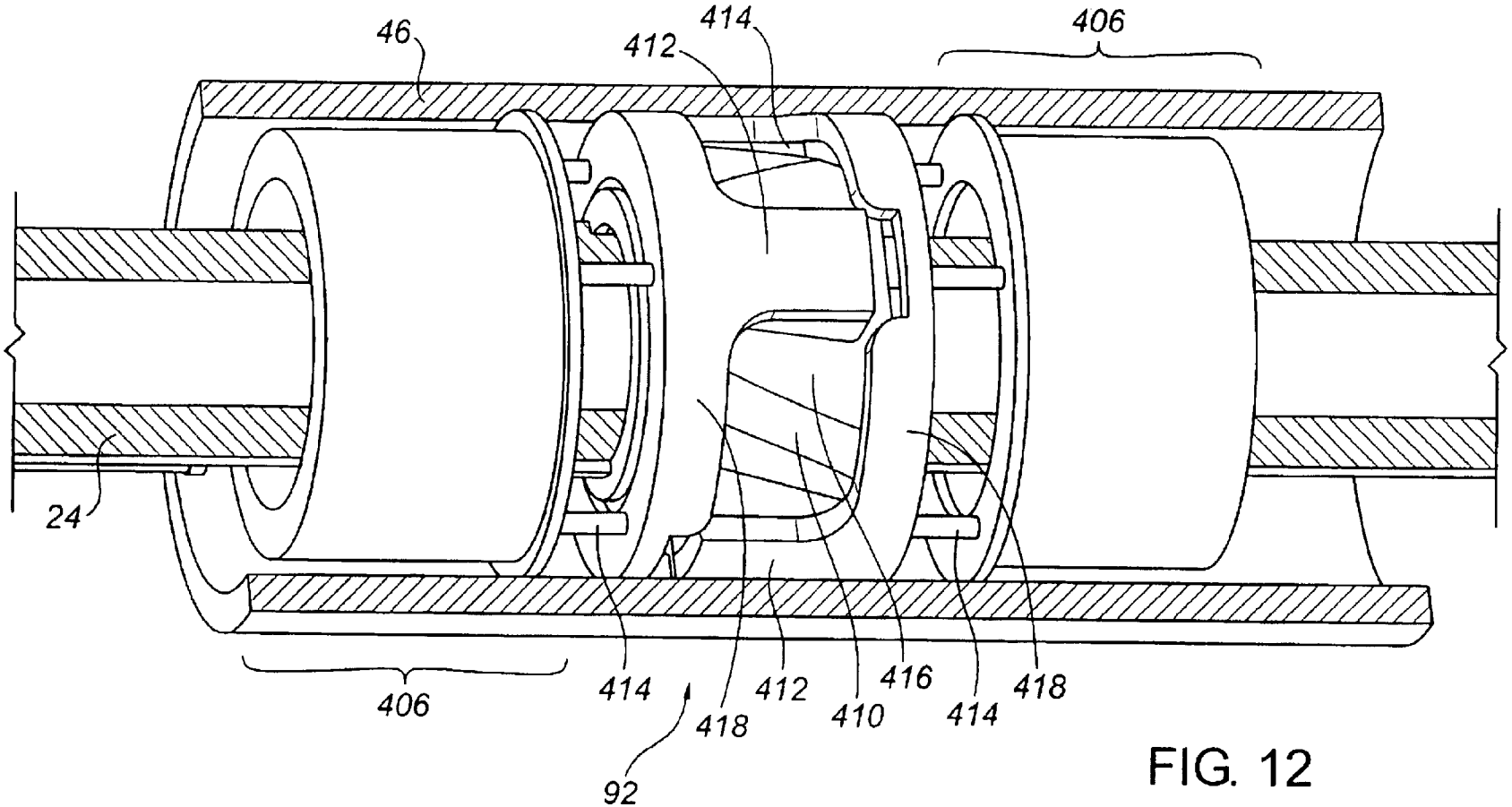
FIG. 12 is a cut-away pictorial view of the drilling shaft deflection assembly depicted in FIG. 11.
Figure 13:
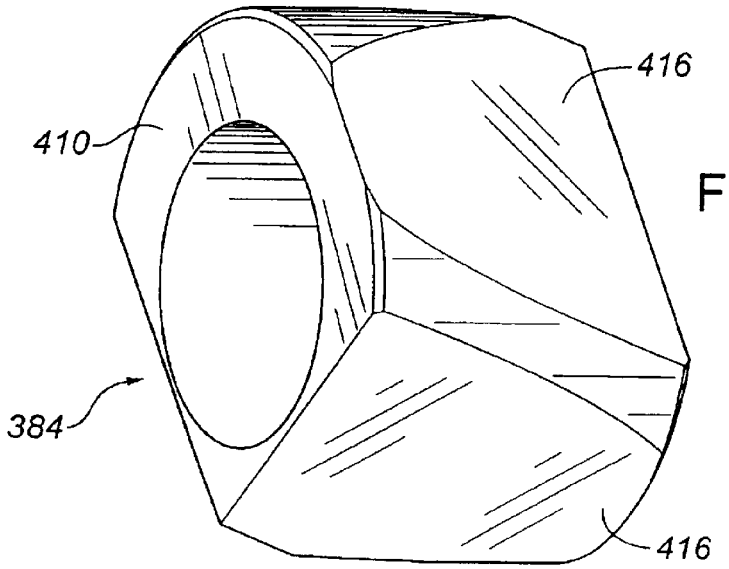
FIG. 13 is a pictorial view of a follower member from the drilling shaft deflection assembly depicted in FIG. 11.

FIGS. 11–13 depict a deflection assembly (92) which provides for bi-axial deflection of the drilling shaft (24).

This bi-axial deflection may be achieved by providing two independent deflection assemblies (92) which provide deflection about different axes. Alternatively, and as depicted in FIGS. 11–13, bi-axial deflection may be achieved by duplicating some components of the deflection assembly (92) while sharing other components of the deflection assembly (92).

Specifically, FIG. 13 depicts a single follower member (410) which includes four follower member surfaces (416). Two follower member surfaces (416) are utilized for bending the drilling shaft (24) about an axis, in order to provide two positions of support for the drilling shaft (24) (i.e., above and below the bend).

Deflection in a single axis therefore requires movement of two separate camming surfaces (412) relative to two follower member surfaces (416). Referring to FIG. 12, this may be accomplished by providing a deflection linkage member (418) which includes two opposed camming surfaces (412). The deflection linkage member (418) is connected with or is part of the deflection actuator member (414). Longitudinal movement of the deflection actuator member (414) results in longitudinal movement of the deflection linkage member (418) and thus longitudinal movement of the two camming surfaces (412).

Deflection in two axes is accomplished by providing two separate deflection actuators (386) and two separate deflection linkage mechanisms (388), while maintaining a single deflection mechanism (384). Each deflection actuator (386) comprises a deflection actuator member (414) and each deflection linkage mechanism (388) comprises a deflection linkage member (418). The deflection actuators may be powered by a common power source (406) or by separate power sources (406).

In the embodiment of deflection assembly (92) which facilitates bi-axial deflection of the drilling shaft (24) with a single follower member (410) as a deflection mechanism (384), forced lateral motion of the follower member (410) must be addressed. In other words, lateral movement of the follower member (410) along one axis will result in relative transverse movement between the camming surfaces (412) and the follower member surfaces (416) which are parallel to the plane of the lateral movement. In the preferred embodiment as depicted in FIG. 13, forced lateral motion is addressed by providing relatively large planar follower member surfaces (416) and by ensuring that the camming surfaces (412) and the follower member surfaces (416) accommodate the forced lateral motion, either by choice of materials or by choice of any bearings which may be provided between the camming surfaces (412) and the follower member surfaces (416).

3. Detailed Description of Indexing Assembly (93)

The indexing assembly (93) may be comprised of any structure or apparatus which is capable of orienting the deflection mechanism (384) to achieve a desired toolface orientation.

The invention encompasses any indexing assembly (93) which includes the following basic components:

(a) an indexing mechanism (420) for imparting rotational movement to the deflection mechanism (384);

(b) an indexing actuator (422) for actuating the indexing mechanism (420) in response to longitudinal movement of the indexing actuator (422); and (c) an indexing linkage mechanism (424) between the indexing mechanism (420) and the indexing actuator (422) for converting longitudinal movement of the indexing actuator (422) to rotational movement of the deflection mechanism (384).

FIG. 7 depicts in detail a drilling direction control device (20) within the scope of the invention which includes a first preferred embodiment of indexing assembly (93). Regardless of the chosen design of indexing assembly (93), the components comprising the indexing assembly (93) may be located generally at the location of the indexing assembly (93) as depicted in FIG. 7(*c*), with minor modification to the device (20) as depicted in FIG. 7.

(a) First Preferred Embodiment of Indexing Assembly (93) (FIGS. 7,8,10)

FIGS. 7, 8 and 10 depict a first preferred embodiment of indexing assembly (93). The first preferred embodiment of indexing assembly (93) is very similar in principle to the Sperry-Sun Drilling Services Coiled Tubing BHA Orienter, which has been adapted for use in orienting the deflection mechanism (384).

Referring to FIG. 8, in the first preferred embodiment of indexing assembly (93), the indexing mechanism (420) is comprised of a rotatable ratchet mechanism (426), the indexing actuator (422) is comprised of a longitudinally movable piston (428), and the indexing linkage mechanism (424) is comprised of a longitudinally movable barrel cam (430).

In the first preferred embodiment of indexing assembly (93), the indexing linkage mechanism (424) is further comprised of a helical groove (432) in the outer surface of the barrel cam (430) which engages a pin (434) on the inner surface of the housing (46) so that longitudinal movement of the piston (428) and the barrel cam (430) will cause the barrel cam (430) to rotate relative to the housing (46) as the pin (434) travels the length of the helical groove (432).

The indexing assembly (93) is further comprised of the power source (406). A single power source (406) may be shared between the deflection assembly (92) and the indexing assembly (93). Alternatively, separate power sources (406) may be provided for the deflection assembly (92) and the indexing assembly (93). The various power sources (406) may be identical, or may be different from each other. For example, the power source (406) for the indexing assembly (93) may be comprised of a similar power source (406) as that used in the Sperry-Sun Drilling Services Coiled Tubing BHA Orienter, in which the piston (428) is driven by drilling fluid passing through the device (20) instead of by a separate hydraulic system.

The first embodiment of indexing assembly (93) may be used with any of the embodiments of deflection assembly (92) described above, but will be unnecessary where the deflection assembly (92) also provides an indexing function, as described below.

(b) Second Preferred Embodiment of Indexing Assembly (93) (FIGS. 3–5)

The second preferred embodiment of indexing assembly (93) is designed specifically for use with the first and second preferred embodiments of deflection assembly (92), but could be adapted for use with other designs of deflection assembly (92) as well.

In the second preferred embodiment of indexing assembly (93), the indexing mechanism (420) is comprised of the deflection mechanism (384) of the first preferred embodiment of deflection assembly (92), the indexing actuator (422) is comprised of the deflection actuator (386) of the first preferred embodiment of deflection assembly (92), and the indexing linkage mechanism (424) is comprised of the deflection linkage mechanism (388) of the first preferred embodiment of deflection assembly.

The operation of the second preferred embodiment of indexing assembly (93) has been described above in connection with the description of the first preferred embodiment of deflection assembly (92), in which the indexing function is provided by indexing segments (409) in the tracks of the sleeve cam (390).

(c) Third Preferred Embodiment of Indexing Assembly (FIGS. 2–6,11–13)

The third preferred embodiment of indexing assembly (93) relies upon multi-axial deflection of the drilling shaft (24) to orient the bend in the drilling shaft (24), and may be used wherever the deflection mechanism (384) facilitates multi-axial deflection of the drilling shaft (24).

A detailed description of the operation of the third preferred embodiment of indexing assembly (93) may be found in U.S. Pat. No. 6,244,361 B1 in connection with a deflection mechanism (384) similar to that which is included in the first preferred embodiment of deflection assembly (92).

4. Detailed Description of Housing Orientation Sensor Apparatus (362) (FIG. 14)

Figure 14:
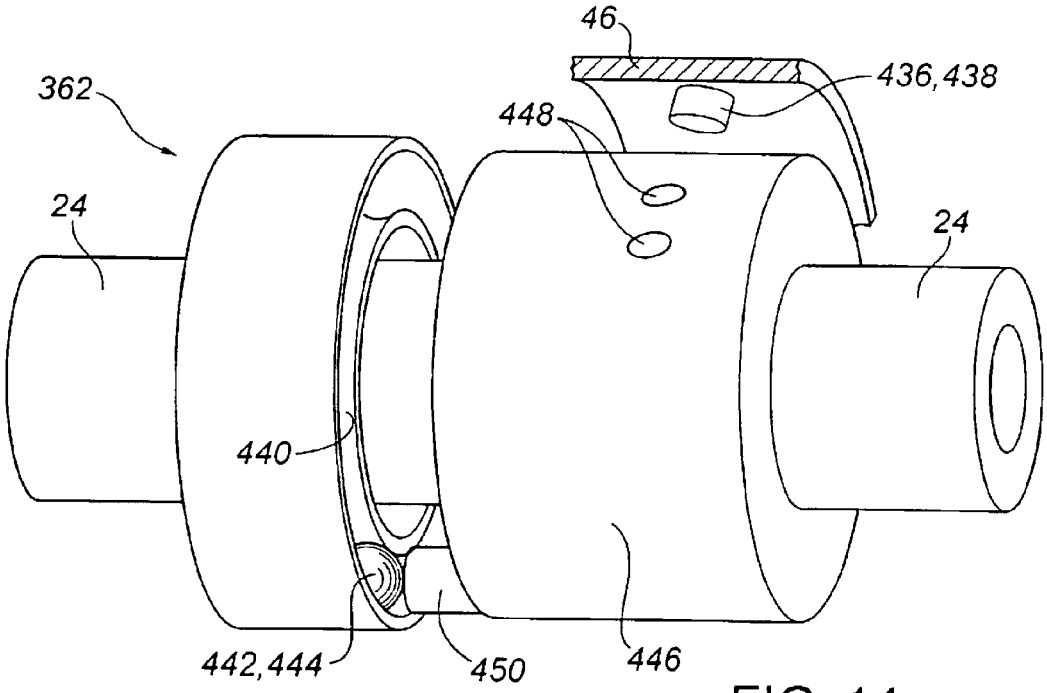
FIG. 14 is a schematic pictorial view of a preferred embodiment of housing orientation sensor apparatus.

The housing orientation sensor apparatus (362) depicted in FIG. 14 is relatively simple in comparison with conventional sensor apparatus such as three dimensional magnetometers and accelerometers. The apparatus (362) depicted in FIG. 14 is intended for use where it is necessary to determine the orientation of the housing (46) relative only to gravity.

Referring to FIG. 14, the housing orientation sensor apparatus (362) is comprised of:

(a) a housing reference indicator (436) which is fixedly connected with the housing (46) at a housing reference position (438);

(b) a circular track (440) surrounding the drilling shaft (24), which circular track (440) houses a metallic gravity reference indicator (442) which moves freely about the circular track (440) in response to gravity, for providing a gravity reference position (444); and (c) a proximity assembly (446) associated with and rotatable with the drilling shaft (24), which proximity assembly (446) includes a housing reference sensor (448) and a gravity reference sensor (450), wherein the housing reference sensor (448) and the gravity reference sensor (450) have a fixed proximity to each other.

In the preferred embodiment, the housing reference indicator (436) is comprised of one or more magnets, the housing reference sensor (448) is comprised of one or more Hall Effect sensors, the gravity reference indicator (442) is comprised of a movable metallic weight, and the gravity reference sensor (450) is comprised of a magnetic proximity sensor. Most preferably the metallic weight is a metal ball which is free to roll around the circular track (440).

The circular track (440) is preferably comprised of a non-metallic material so that it does not interfere with the sensing of the gravity reference indicator (442). Preferably the circular track (440) is fixed in relation to the housing (46).

The proximity assembly (446) is fixed to the drilling shaft (24) so that it will rotate with the drilling shaft (24). The proximity assembly (446) may be integral with the drilling shaft (24) or may be fixedly connected with the drilling shaft (24).

The position of the housing reference indicator (436) is fixed in relation to the housing (46) at a known orientation relative to a reference position (such as a theoretical "high side"). The relative positions of the housing reference sensor (448) and the gravity reference sensor (450) are fixed in relation to each other. As a result, by sensing the relative positions of the housing reference indicator (436) and the gravity reference indicator (442), it is possible to determine the orientation of the housing (46) relative to gravity (i.e., the actual low side).

The configuration described above may be altered so that the housing reference indicator (436) is on the proximity assembly (446) and the housing reference sensor is on the housing (46). Similarly, it may be possible to locate the gravity reference indicator (442) on the proximity assembly (446) and thus locate the gravity reference sensor (450) in the circular track (440), although this configuration may be impractical.

Figure 15A:
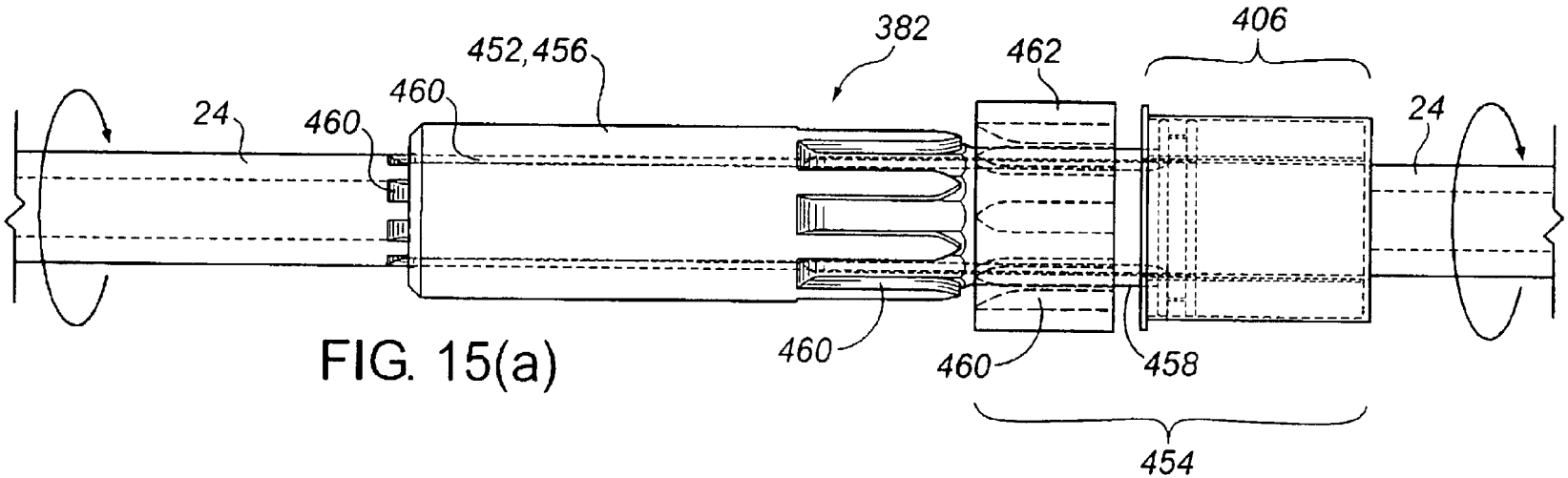
FIGS. 15(*a*) and 15(*b*) are schematic longitudinal cross-section views of a preferred embodiment of a housing locking mechanism, with FIG. 15(*a*) depicting the drilling shaft and the housing in a disengaged configuration and FIG. 15(*b*) depicting the drilling shaft and the housing in an engaged configuration.
Figure 15B:
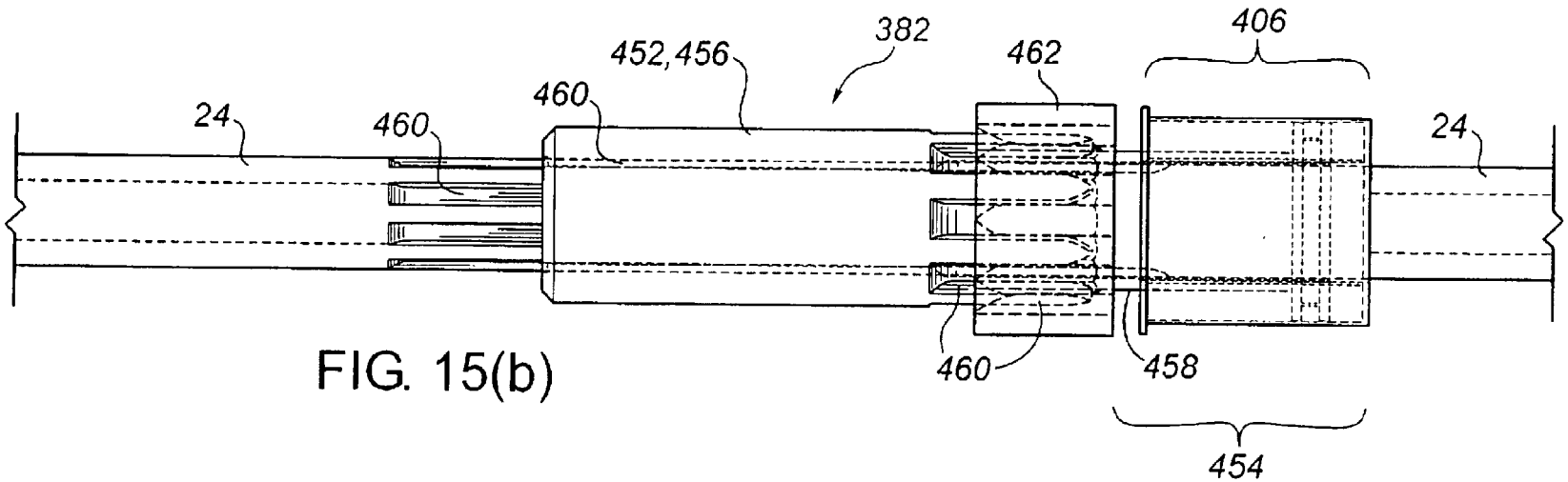

5. Detailed Description of Housing Locking Assembly (382) (FIG. 15)

The housing locking assembly (382) may be comprised of any structure or apparatus which is capable of engaging the drilling shaft (24) with the housing (46) so that they rotate together.

The housing locking assembly (382) is comprised of a housing locking mechanism (452) for engaging the drilling shaft (24) with the housing (46) and is further comprised of a housing locking actuator (454) for actuating the housing locking mechanism (452).

In the preferred embodiment of housing locking assembly (382), the housing locking mechanism (452) is comprised of a locking sleeve (456) which is longitudinally movable between positions where the drilling shaft (24) and the housing (46) are engaged and disengaged, and the housing locking actuator (454) is comprised of a longitudinally movable locking actuator member (458) which is connected with the locking sleeve (456). The locking actuator member (458) may be integral with the locking sleeve (456) as part of the locking sleeve (456) or may be otherwise connected with the locking sleeve (456). In the preferred embodiment, the housing locking mechanism (452) is further comprised of complementary engagement surfaces (460) on each of the drilling shaft (24), the housing (46) and the locking sleeve (456) so that when the locking sleeve (456) is actuated to engage the drilling shaft (24) and the housing (46), the engagement surfaces (460) on each of the drilling shaft (24), the housing (46) and the locking sleeve (456) are brought into engagement.

The complementary engagement surfaces (460) on the housing (46) may be integral with the housing (46) or may be provided by a structure which is connected with the housing (46), such as a locking ring (462).

In the preferred embodiment, the complementary engagement surfaces (460) are comprised of splines.

The housing locking actuator (454) includes the power source (406). The power source (406) may be comprised of the flow of drilling fluid through the device (20). Preferably, however, the power source (406) is comprised of a hydraulic system which is powered by rotation of the drilling shaft (24). In the preferred embodiment, the power source (406) for the housing locking assembly (382) is double acting so that the power source (406) is effective both to engage and disengage the drilling shaft (24) and the housing (46).

In the preferred embodiment the power source (406) for the housing locking assembly (382) is separate from the power sources (406) for the deflection assembly (92) and the indexing assembly (93). A single power source (406) may, however, be used to power each of the deflection assembly (92), the indexing assembly (93) and the housing locking assembly (382).

The embodiments of the invention in which an exclusive property or privilege is claimed are defined as follows:

1. In a tool having an inner member supported within an outer member, wherein the toot defines a longitudinal axis, a device for preventing relative rotation of the inner member and the outer member, the device comprising:

(a) a locking mechanism positioned radially between the inner member and the outer member, wherein the locking mechanism is movable longitudinally between a first locking mechanism position in which the inner member and the outer member are disengaged and capable of relative rotation and a second locking mechanism position in which the inner member and the outer member are engaged and not capable of relative rotation; and (b) a locking actuator for causing the locking mechanism to move longitudinally.

2. The device as claimed in claim 1 wherein the locking actuator is capable of moving the locking mechanism both from the first locking mechanism position to the second locking mechanism position and from the second locking mechanism position to the first locking mechanism position.

3. The device as claimed in claim 2 wherein the locking actuator is comprised of a power source for causing the locking mechanism to move longitudinally.

4. The device as claimed in claim 3 wherein the power source is comprised of a hydraulic system.

5. The device as claimed in claim 4 wherein the hydraulic system is comprised of an actuator piston and an actuator cylinder, wherein the actuator piston and the actuator cylinder move longitudinally relative to each other in order to cause the locking mechanism to move longitudinally.

6. The device as claimed in claim 5 wherein the actuator piston is connected with the locking mechanism and wherein the actuator piston moves longitudinally relative to the actuator cylinder in order to cause the locking mechanism to move longitudinally.

7. The device as claimed in claim 5 wherein the actuator piston and the actuator cylinder are positioned between the inner member and the outer member.

8. The device as claimed in claim 5 wherein the hydraulic system is further comprised of a pump for supplying a hydraulic fluid to the actuator cylinder.

9. The device as claimed in claim 8 wherein the pump is powered by rotation of the inner member.

10. The device as claimed in claim 9 wherein the pump is positioned between the inner member and the outer member.

11. The device as claimed in claim 3 wherein the power source is double acting so that the locking actuator is capable of moving the locking mechanism both from the first locking mechanism position to the second locking mechanism position and from the second locking mechanism position to the first locking mechanism position.

12. The device as claimed in claim 1 wherein the locking sleeve is comprised of an inner member engagement surface which is adapted to engage with the inner member to prevent relative rotation of the inner member and the locking sleeve and wherein the locking sleeve is further comprised of an outer member engagement surface which is adapted to engage with the outer member to prevent relative rotation of the outer member and the locking sleeve.

13. The device as claimed in claim 12 wherein the locking sleeve is slidably mounted on the inner member so that the locking sleeve is movable longitudinally between the first looking mechanism position and the second locking mechanism position.

14. The device as claimed in claim 13 wherein the inner member engagement surface engages the inner member to prevent relative rotation of the inner member and the locking sleeve in both the first locking mechanism position and the second locking mechanism position.

15. The device as claimed in claim 14 wherein the outer member engagement surface engages the outer member to prevent relative rotation of the outer member and the locking sleeve only in the second locking mechanism position.

16. The device claimed in claim 15 wherein the locking actuator is capable of moving the locking mechanism both from the first locking mechanism position to the second locking mechanism position and form the second locking mechanism position to the first locking mechanism.

17. The device as claimed in claim 15 wherein the inner member is comprised of a rotatable drilling shaft and wherein the outer member is comprised of a housing.

18. The device as claimed in claim 12 wherein the inner member engagement surface is comprised of a plurality of splines which are adapted to engage a plurality of complementary splines associated with the inner member.

19. The device as claimed in claim 12 wherein the outer member engagement surface is comprised of a plurality of splines which are adapted to engage a plurality of complementary splines associated with the outer member.

20. The device is claimed in claim 19 wherein the inner member engagement surface is comprised of a plurality of splines which are adapted to engage a plurality of complementary splines associated with the inner member.

21. The device as claimed in claim 20 wherein the locking actuator is capable of moving the locking mechanism both from the first locking mechanism position to the second locking mechanism position and from the second locking mechanism position to the first locking mechanism position.

22. The device as claimed in claim 20 wherein the inner member is comprised of a rotatable drilling shaft and wherein the outer member is comprised of a housing.

23. The device as claimed in claim 22 wherein the locking actuator is comprised of a power source for causing the locking mechanism to move longitudinally.

24. The device as claimed in claim 23 wherein the power source is double acting so that the locking actuator is capable of moving the locking mechanism both from the first locking mechanism position to the second locking mechanism position and from the second locking mechanism position to the first locking mechanism position.

25. The device as claimed in claim 12 further comprising a locking ring connected with the outer member, wherein the outer member engagement surface is adapted to engage the locking ring to prevent relative rotation of the outer member and the locking sleeve.

26. The device as claimed in claim 25 wherein the locking ring is positioned between the inner member and the outer member.

27. The device as claimed in claim 28 wherein the locking actuator is capable of moving the locking mechanism both from the first locking mechanism position to the second locking mechanism position and from the second locking mechanism position to the first locking mechanism position.

28. The device as claimed in claim 12 wherein the inner member is comprised of a rotatable drilling shaft and wherein the outer member is comprised of a housing.

29. The device as claimed in claim 28 wherein the locking actuator is capable of moving the locking mechanism both from the first locking mechanism position to the second locking mechanism position and from the second locking mechanism position to the first locking mechanism position.

30. The device as claimed in claim 12 wherein the locking actuator is capable of moving the locking mechanism both from the first locking mechanism position to the second locking mechanism position and from the second locking mechanism position to the first locking mechanism position.

31. The device as claimed in claim 12 wherein the locking actuator is comprised of a power source for causing the locking mechanism to move longitudinally.

32. The device as claimed in claim 31 wherein the power source in double acting so that the locking actuator is capable of moving the locking mechanism both from the first locking mechanism position to the second locking mechanism position and from the second locking mechanism position to the first locking mechanism position.

33. The device as claimed in claim 32 wherein the inner member is comprised of a rotatable drilling shaft and wherein the outer member is comprised of a housing.

34. The device as claimed in claim 32 wherein the power source is comprised of a hydraulic system.

35. The device as claimed in claim 34 wherein the hydraulic system is comprised of an actuator piston and an actuator cylinder, wherein the actuator piston and the actuator cylinder move longitudinally relative to each other in order to cause the locking mechanism to move longitudinally.

36. The device as claimed in claim 35 wherein the actuator piston is connected with the locking mechanism and wherein the actuator piston moves longitudinally relative to the actuator cylinder in order to cause the locking mechanism to move longitudinally.

37. The device as claimed in claim 35 wherein the actuator piston and the actuator cylinder are positioned between the inner member and the outer member.

38. The device as claimed in claim 35 wherein the hydraulic system is further comprised of a pump for supplying a hydraulic fluidto the actuator cylinder.

39. The device as claimed in claim 38 wherein the pump is powered by rotation of the inner member.

40. The device as claimed in claim 39 wherein the pump is positioned between the inner member and the outer member.

41. The device as claimed in claim 1 wherein the inner member is comprised of a rotatable drilling shaft and wherein the outer member is comprised of a housing.

* * * * *

UNITED STATES PATENT AND TRADEMARK OFFICE

CERTIFICATE OF CORRECTION

PATENT NO. : 7,234,544 B2
APPLICATION NO. : 10/876661
DATED : June 26, 2007
INVENTOR(S) : Gerald Edward Kent It is certified that error appears in the above-identified patent and that said Letters Patent is hereby corrected as shown below:

Column 33, line 64, “toot” should be changed to --tool--.
Column 34, line 7, after “rotation” insert --and wherein the locking mechanism is comprised of a locking sleeve which surrounds the inner member--.
Column 34, lines 56-67, “first looking mechanism position” should be changed to --first locking mechanism position--.
Column 35, line 1, “device claimed” should be changed to --device as claimed--
Column 35, line 4, claim 16 “form” should be changed to --from--.
Column 35, line 46, claim 16 “claim 28” should be changed to --claim 26--.
Column 36, line 15, claim 27 “source in double acting” should be changed to --source is double acting--.
Column 36, line 41, claim 38 “fluidto” should be changed to --fluid to--.

Signed and Sealed this

Eleventh Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,234,544 B2
APPLICATION NO. : 10/876661
DATED : June 26, 2007
INVENTOR(S) : Gerald Edward Kent It is certified that error appears in the above-identified patent and that said Letters Patent is hereby corrected as shown below:

Column 33, line 64, "toot" should be changed to --tool--.
Column 34, line 7, after "rotation" insert --and wherein the locking mechanism is comprised of a locking sleeve which surrounds the inner member--.
Column 34, lines 56-67, "first looking mechanism position" should be changed to --first locking mechanism position--.
Column 35, line 1, "device claimed" should be changed to --device as claimed--.
Column 35, line 4, claim 16 "form" should be changed to --from--.
Column 35, line 46, claim 27, "claim 28" should be changed to --claim 26--.
Column 36, line 15, claim 32, "source in double acting" should be changed to --source is double acting--.
Column 36, line 41, claim 38 "fluidto" should be changed to --fluid to--.

This certificate supersedes the Certificate of Correction issued December 11, 2007.

Signed and Sealed this

Thirtieth Day of March, 2010

David J. Kappos

David J. Kappos
*Director of the United States Patent and Trademark Office*